US006128452A

United States Patent [19]

Miyabe et al.

[11] Patent Number: 6,128,452

[45] Date of Patent: Oct. 3, 2000

[54] PROCESS CARTRIDGE AND IMAGE FORMING APPARATUS HAVING PARTICULAR ARRANGEMENT OF ELECTRICAL CONTACTS

[75] Inventors: Shigeo Miyabe, Yokohama; Atsushi Kubota, Machida, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/122,381

[22] Filed: Jul. 24, 1998

Related U.S. Application Data

[62] Division of application No. 08/968,727, Nov. 12, 1997, Pat. No. 5,873,012.

[30] Foreign Application Priority Data

Apr. 27, 1994 [JP] Japan ..... 6-089788
Apr. 19, 1995 [JP] Japan ..... 7-093643

[51] Int. Cl.[7] ..... G03G 15/00

[52] U.S. Cl. ..... 399/90; 399/111

[58] Field of Search ..... 399/111, 113, 399/90, 89, 88, 117, 13

[56] References Cited

U.S. PATENT DOCUMENTS 4,591,258 5/1986 Nishino et al. .
4,924,267 5/1990 Yoshikawa et al. .

(List continued on next page.)

FOREIGN PATENT DOCUMENTS 0281372 9/1988 European Pat. Off. .
0285139 10/1988 European Pat. Off. .
0466173 1/1992 European Pat. Off. .
0468751 1/1992 European Pat. Off. .
0572738 12/1993 European Pat. Off. .
0586046 3/1994 European Pat. Off. .
02163761 6/1990 Japan .
4018920 2/1992 Japan .
6-19242 1/1994 Japan .
6-83123 3/1994 Japan .
6-208260 7/1994 Japan .
6-317961 11/1994 Japan .
WO92/18910 10/1992 WIPO .

*Primary Examiner*—Robert Beatty
*Attorney, Agent, or Firm*—Fitzpatrick, Cella, Harper & Scinto

[57] ABSTRACT

A process cartridge detachably mountable to a main assembly of an image forming apparatus includes an electrophotographic photosensitive member, a guiding member, a charging device for charging the photosensitive member, a developing device for developing a latent image formed on the photosensitive member, a cartridge frame, a grounding contact for electrically grounding the photosensitive member to the main assembly when the process cartridge is mounted to the main assembly, a charging bias contact for receiving charging bias voltage from the main assembly to be applied to the charging device when the process cartridge is mounted to the main assembly, a developing bias contact for receiving a developing bias voltage to be applied to the developing device when the process cartridge is mounted to the main assembly, a detection contact for permitting detection of mounting of the process cartridge to the main assembly to provide notification to the main assembly that the process cartridge is mounted to the main assembly. The grounding contact, the charging bias contact, the developing bias contact and the detection contact are provided on a side surface of the cartridge frame.

24 Claims, 22 Drawing Sheets

U.S. PATENT DOCUMENTS 5,047,803 9/1991 Kanoto .
5,126,789 6/1992 Fukuchi et al. .
5,142,322 8/1992 Sirto .
5,177,529 1/1993 Sholl et al. .
5,331,373 7/1994 Nomura et al. .
5,463,446 10/1995 Watanabe et al. .
5,500,714 3/1996 Yashiro et al. .
5,510,878 4/1996 Noda et al. .
5,585,889 12/1996 Shishido et al. .
5,614,992 3/1997 Kikuchi et al. .
5,640,649 6/1997 Kikuchi et al. .
5,652,647 7/1997 Washiro et al. .
5,873,012 2/1999 Miyabe et al. ..... 399/90

(a)

(b)

PROCESS CARTRIDGE AND IMAGE FORMING APPARATUS HAVING PARTICULAR ARRANGEMENT OF ELECTRICAL CONTACTS

This Appln is a Div of Ser. No. 08/968,727, Nov. 12, 1997 U.S. Pat. No. 5,873,012.

FIELD OF THE INVENTION AND RELATED ART

The present invention relates to a process cartridge and an image forming apparatus usable with the process cartridge.

Here, the image forming apparatus includes an electrophotographic copying machine, an electrophotographic printer (for example, LED printer, laser beam printer), an electrophotographic facsimile machine, an electrophotographic word processor, and the like.

The process cartridge means a cartridge having as a unit an electrophotographic photosensitive member, and charging means, developing means and cleaning means, which is detachably mountable to a main assembly of an image forming apparatus. It may include as a unit an electrophotographic photosensitive member and at least one of charging means, developing means and cleaning means. It may include as a unit developing means and an electrophotographic photosensitive member.

An image forming apparatus using an electrophotographic process is known which is used with the process cartridge. This is advantageous in that the maintenance operation can be, in effect, carried out by the users thereof without expert service persons, and therefore, the operation can be remarkably improved. Therefore, this type is now widely used.

In the process cartridge, improvement in the operation in mounting and demounting relative to the main assembly of the image forming apparatus is desired.

It is also desired that electric connections are more assuredly and accurately established between the process cartridge and the main assembly, when the process cartridge is mounted to the main assembly.

Some improvement is disclosed in Japanese Laid-open Patent Application No. 163761/1990 (laid open on Jun. 25, 1990), wherein an end surface of the process cartridge is provided with a charger contact for connection with a charger, a grid contact for connection with a grid, a drum ground contact for connection with the drum, a bias contact for connection with a developing device, and an antenna contact for connection with the antenna.

This is very effective for the assured and accurate electric connection establishment.

The present invention is intended to provide a further improvement.

SUMMARY OF THE INVENTION

Accordingly, it is a principal object of the present invention to provide a process cartridge and an image forming apparatus usable with the process cartridge wherein electric connection between the process cartridge and the main assembly of the image forming apparatus can be further improved.

It is another object of the present invention to provide a process cartridge and a image forming apparatus usable with the process cartridge wherein the image quality can be improved by the further assured and further accurate electric connection between said process cartridge and said main assembly.

It is a further object of the present invention to provide a process cartridge and an image forming apparatus usable with the process cartridge wherein the operation in the mounting and demounting of the process cartridge relative to the main assembly of the image forming apparatus is improved, and the electric connection therebetween is assured.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, preferable embodiments of the present invention will be described.

Figure 1:
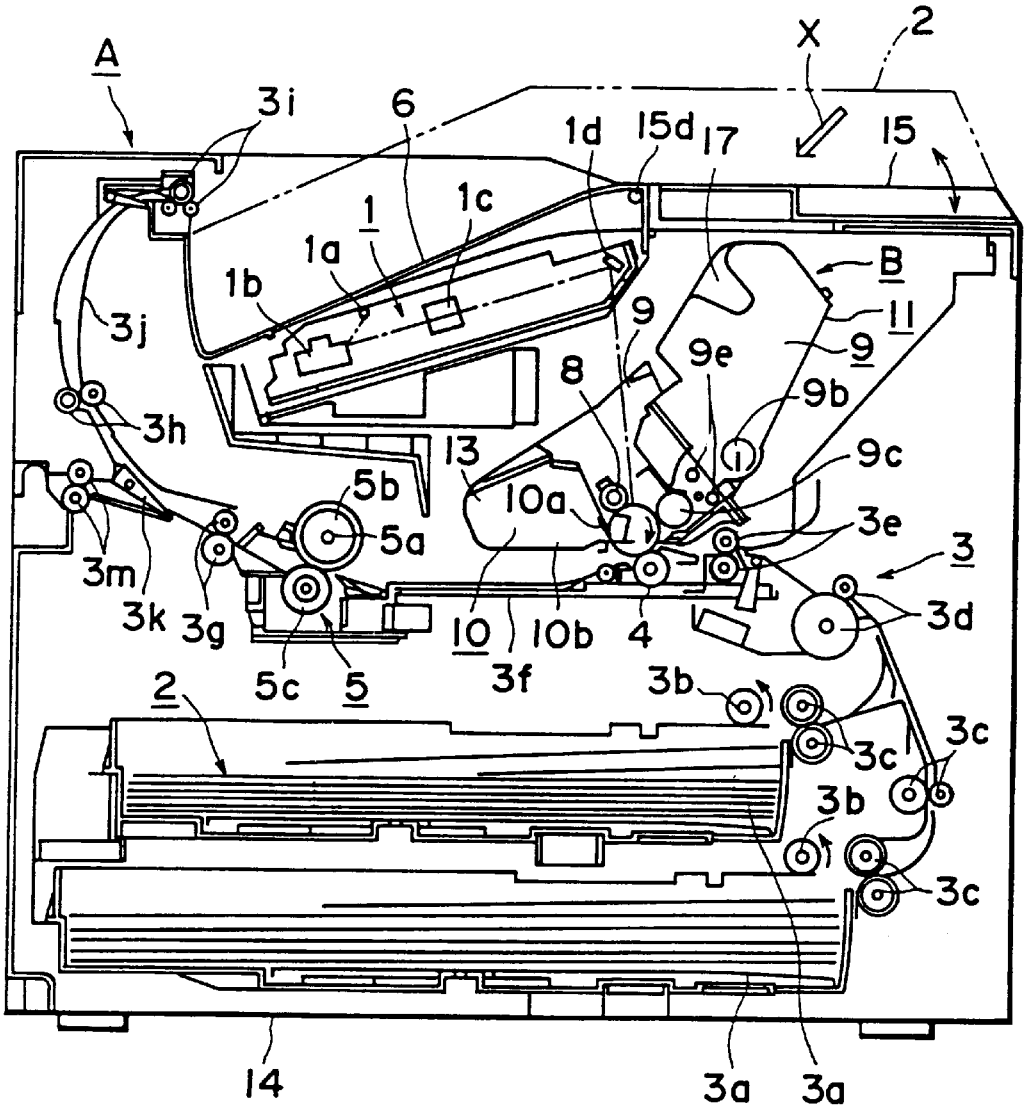
FIG. 1 is a sectional view of the first embodiment of electrophotographic image forming apparatus according to the present invention.
Figure 2:
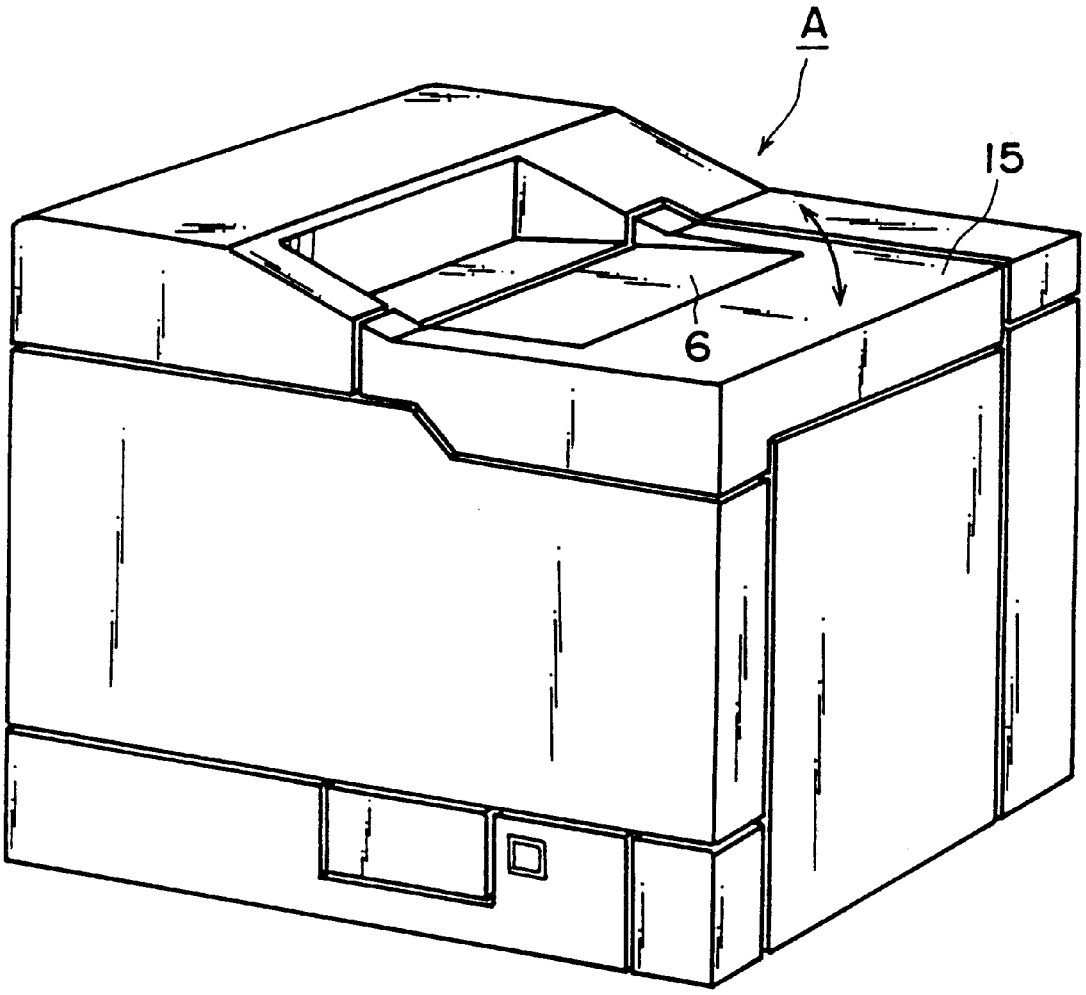
FIG. 2 is a perspective view of the apparatus illustrated in FIG. 1.
Figure 3:
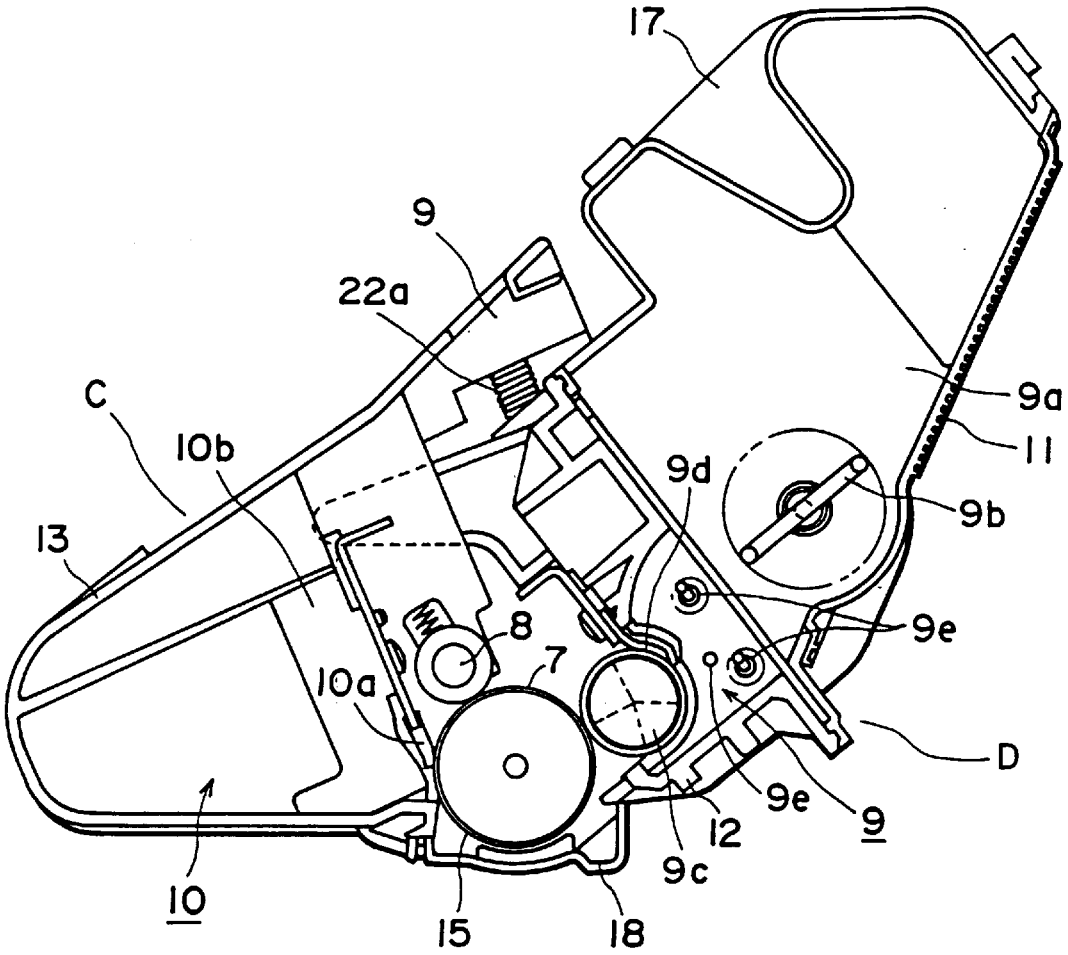
FIG. 3 is a sectional view of a process cartridge to which the first embodiment of the present invention has been applied.
Figure 4:
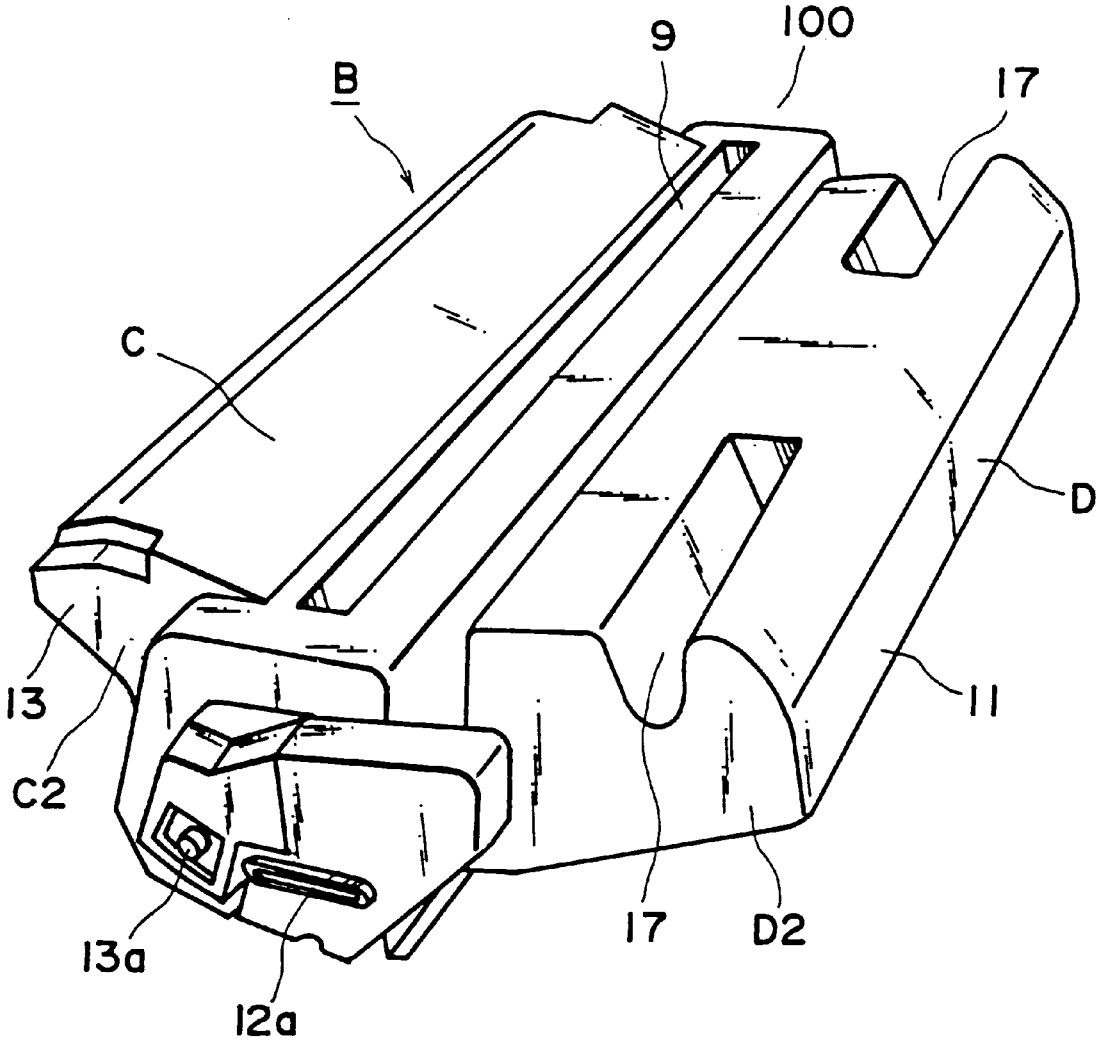
FIG. 4 is a schematic, perspective and external view of the process cartridge illustrated in FIG. 1.
Figure 5:
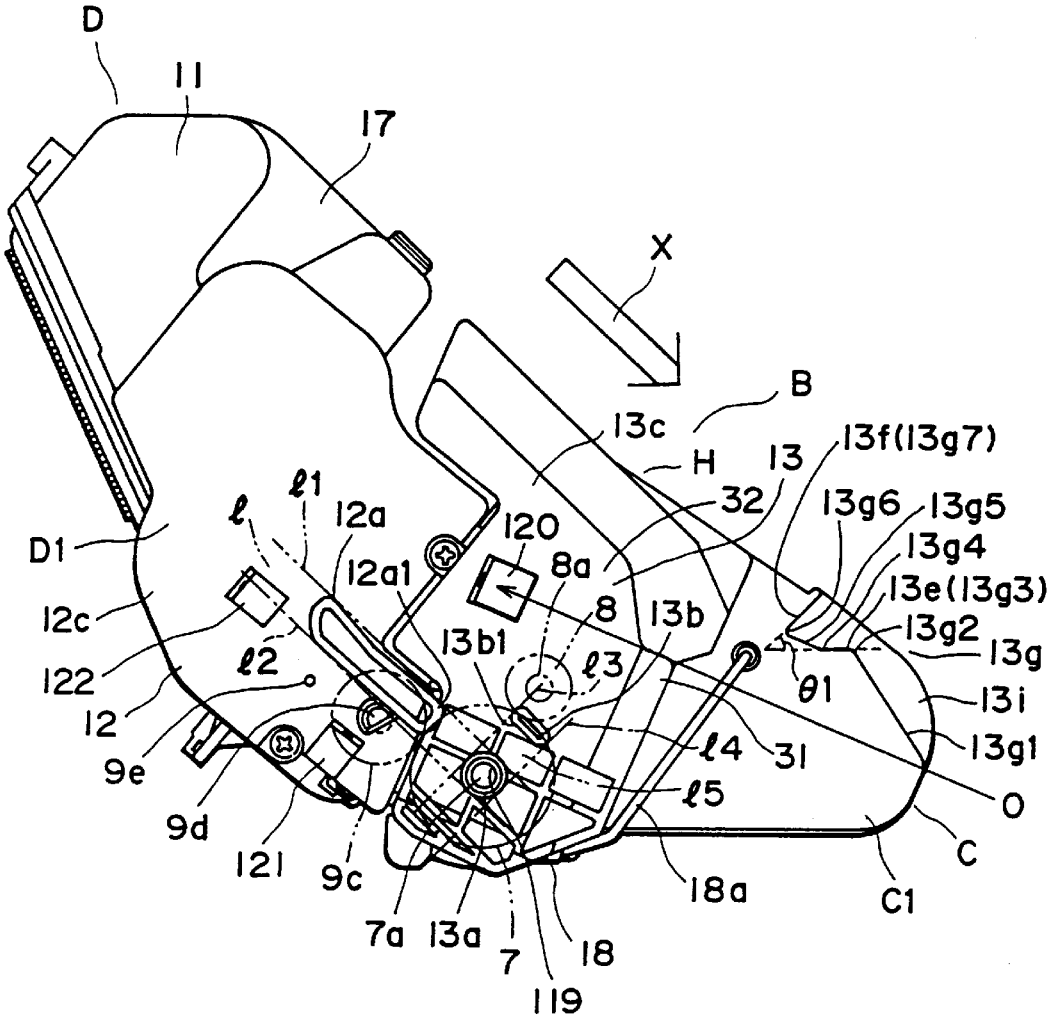
FIG. 5 is a right-hand side view of the process cartridge illustrated in FIG. 1.
Figure 6:
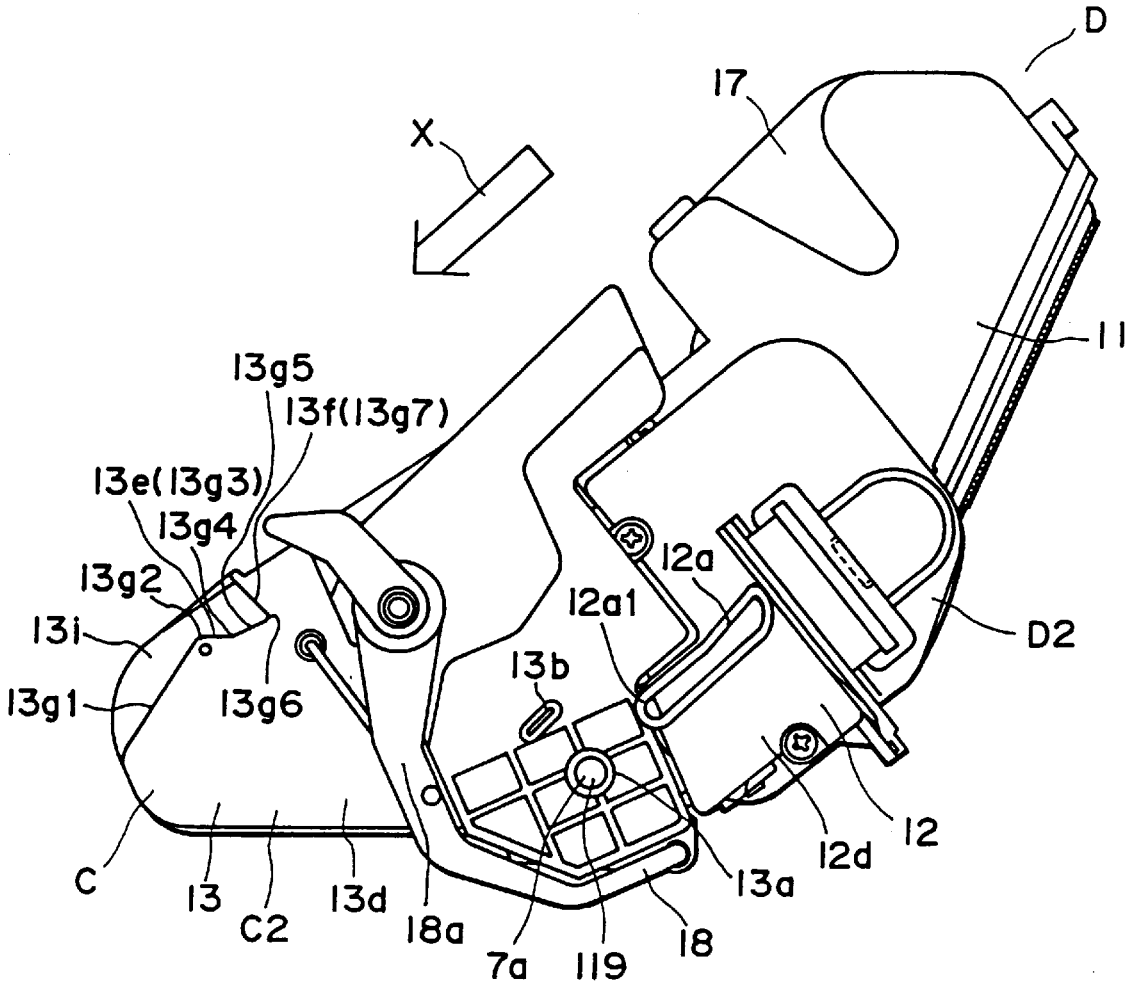
FIG. 6 is a left-hand side view of the process cartridge illustrated in FIG. 1.
Figure 7:
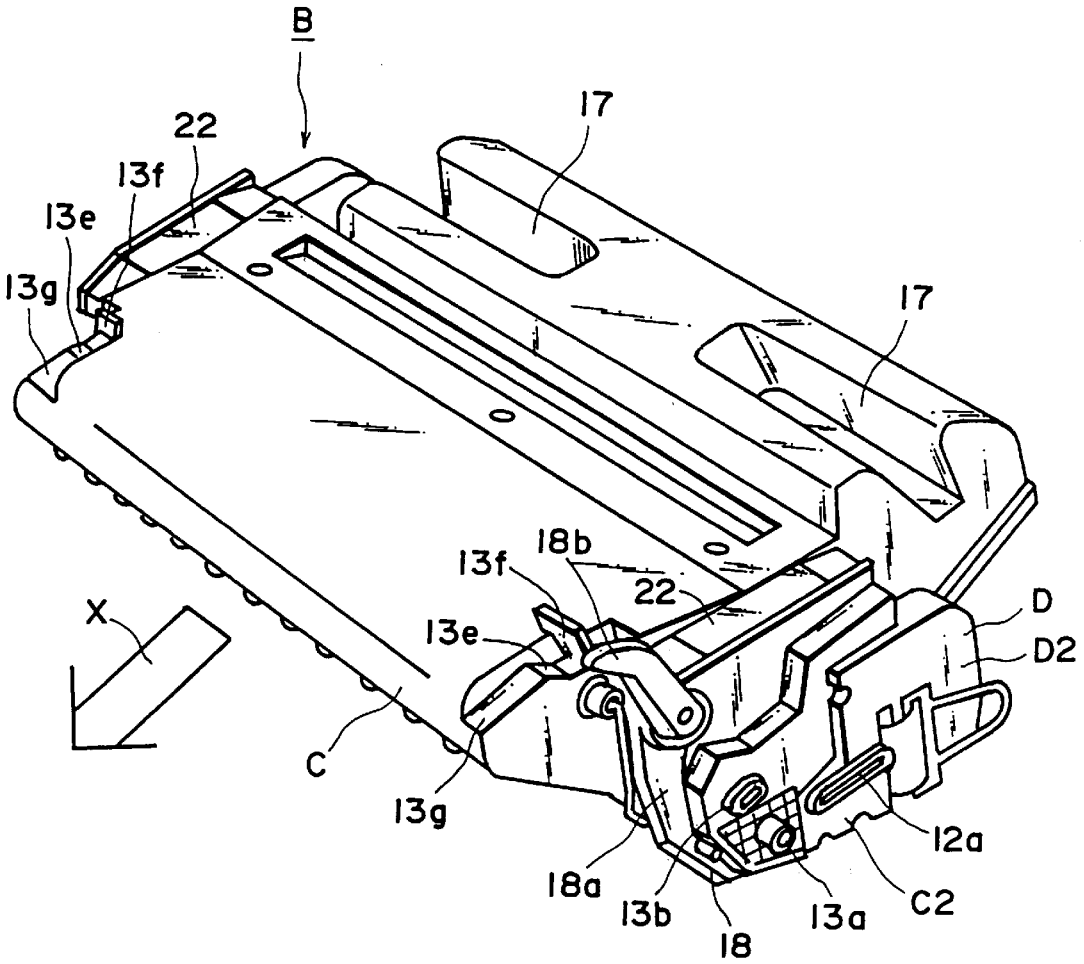
FIG. 7 is a perspective external view of the process cartridge illustrated in FIG. 1.
Figure 8:
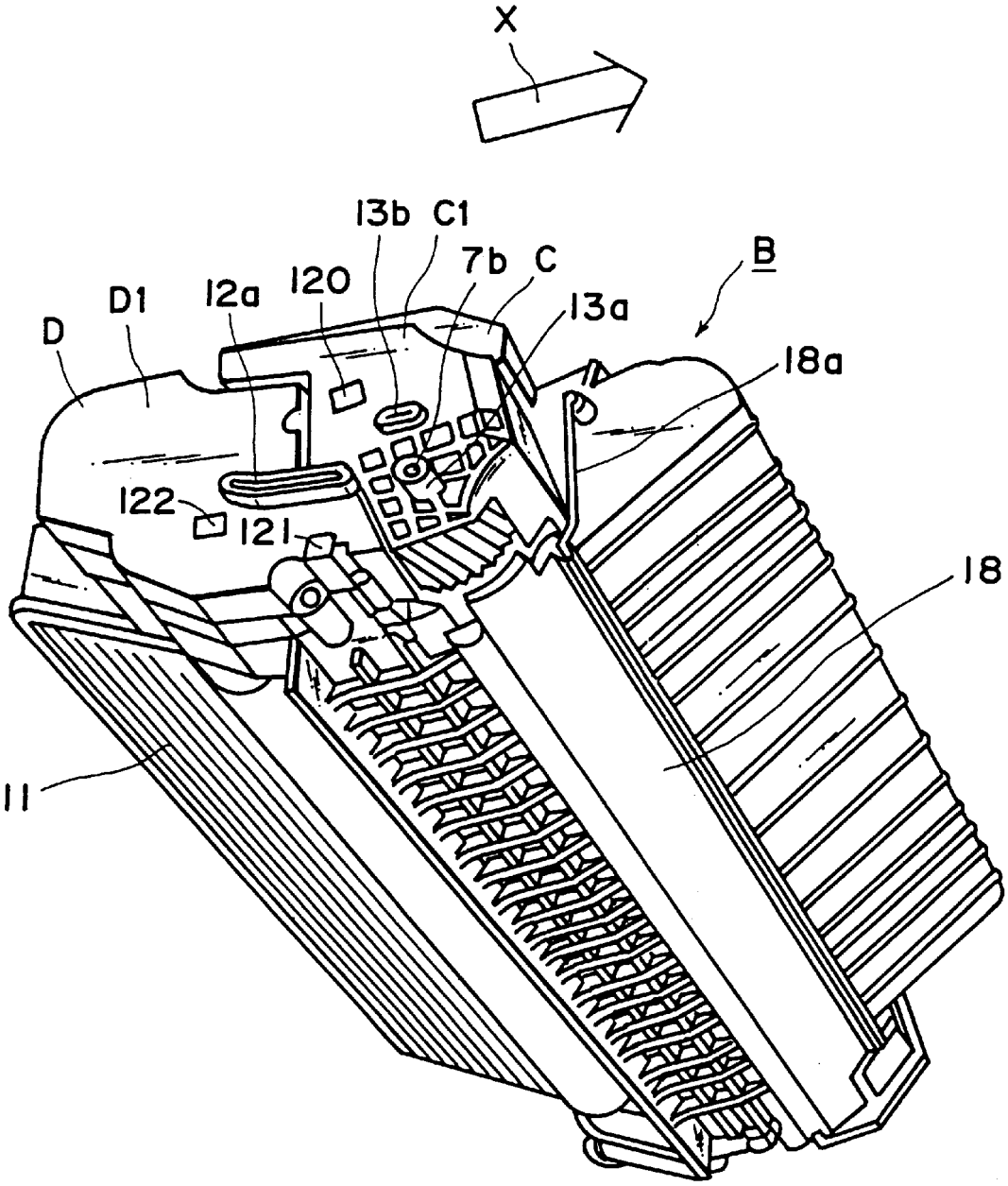
FIG. 8 is a perspective external view of the process cartridge illustrated in FIG. 1, as seen from underneath.

FIG. 1 is a sectional view of an embodiment of an electrophotographic image forming apparatus according to the present invention, and illustrates the structure thereof. FIG. 2 is a perspective external view thereof. FIGS. 3–8 are drawings of the process cartridge to which the first embodiment of the present invention has been applied, wherein FIG. 3 is a cross-sectional view; FIG. 4, a schematic, perspective and external view; FIG. 5, a right-hand side view; FIG. 6, a left-hand side view; FIG. 7, a perspective view as seen from above; and FIG. 8 is a perspective view as seen from underneath.

Electrophotographic Image Forming Apparatus A and Process Cartridge B

To begin with, referring to FIGS. 1 and 2, an electrophotographic image forming apparatus, to which the first embodiment of the present invention has been applied, will be described. FIG. 3 is a side view of a process cartridge B.

Referring to FIG. 1, this electrophotographic image forming apparatus A is of a type which forms an image on recording medium through the electrophotographic image forming process. First, a toner image is formed on a drum shaped electrophotographically sensitive member (hereinafter, photosensitive drum) as an image bearing member. Meanwhile, a sheet of recording medium 2 placed in a cassette 3*a* is conveyed, being thereby fed out, by a conveying means 3 comprising a pair of pickup rollers 3*b* and 3*c,* and a pair of registration rollers 3*d* and 3*e,* and the like, in synchronously with the toner image formation. Next, a voltage is applied to a transfer roller 4 as transferring means, whereby the toner image formed on the photosensitive drum, which a process cartridge B comprises, is transferred onto the recording medium 2. Then, the recording medium having received the toner image is delivered to a fixing means 5. This fixing means 5 comprises a driving roller 5*c* and a fixing roller 5*b* containing a heater 5*a,* and applies heat and pressure to the recording medium 2, which is passed through the fixing means 5, whereby the transferred toner image is fixed. Next, the recording medium 2 now bearing the fixed toner image is conveyed and discharged into a discharge tray 6, through a sheet-reversing path 3*j,* by a group of discharging roller pairs 3*g,* 3*h* and 3*i.* This discharge tray 6 is provided on the top surface of the apparatus A main assembly. The apparatus A comprises also a pivotable flapper 3*k* and a discharge roller pair 3*m,* and when this flapper 3*k* is operated, the recording medium 2 can be discharged without being flipped over through the discharge roller pair 3*m,* without going through the sheet-reversing path 3*j.*

In the process cartridge B, the surface of a photosensitive drum 7 as the image bearing member with a photosensitive layer 7*e* (FIG. 26) is uniformly charged by applying a voltage to a charging roller 8, which is a charging means, while the photosensitive drum 7 is rotated. Next, a laser beam carrying the image data is projected by an optical system 1 onto the photosensitive drum 7 through an exposure opening 9, whereby a latent image is formed on the photosensitive drum 7. This latent image is developed with toner by a developing means 9.

The charging roller 8 is placed in contact with the photosensitive drum 7 to charge the photosensitive drum 7, wherein this charging roller 8 is rotated by the rotation on the photosensitive drum 7. The developing means 9 develops the latent image formed on the photosensitive drum 7, by supplying the toner to the photosensitive drum 7, on the regions to be developed. The optical system 1 comprises a laser diode 1*a,* a polygon mirror 1*b,* a lens 1*c,* and a full reflection mirror 1*d.*

In this developing means 9, as a developing roller 9*c,* in which a magnet is fixed, is rotated, a layer of toner triboelectrically charged by a developing blade 9*d* is formed on the surface of the developing roller 9*c.* The toner is supplied from this toner layer to the photosensitive drum 7, on the region to be developed. As the toner is transferred onto the photosensitive drum 7 in correspondence with the latent image, the latent image is visualized. This developing blade 9*d* regulates the amount of the toner coated on the peripheral surface of the developing roller 9*c.* Also, a stirring member 9*e* for circulating the toner is rotatively mounted adjacent to the developing roller 9*c.*

Next, a voltage with a polarity opposite to that of the toner image is applied to the transfer roller 4, whereby the toner image on the photosensitive drum 7 is transferred onto the recording medium 2. Then, the residual toner on the photosensitive drum 7 is removed by a cleaning means 10. The cleaning means 10 comprises an elastic cleaning blade 10*a,* and the toner remaining on the photosensitive drum 7 is scraped off by the elastic cleaning blade 10*a* to be collected in a waste toner collector 10*b.*

The process cartridge B is formed by combining: a toner chamber portion 11 of the cartridge frame (hereinafter toner chamber frame), which constitutes a portion of the toner container 11*a* for storing the toner; a developing chamber portion 12 of the frame (hereinafter, developing chamber frame), which contains the developing means such as the developing roller 9*c;* and a cleaning means portion 13 of the frame (hereinafter, cleaning means frame), which comprises the photosensitive drum 7, cleaning blade 10*a,* and the like. This process cartridge B is removably installed in the apparatus A main assembly.

The process cartridge B is provided with an exposure opening 9, which allows the light beam carrying the image data to be irradiated onto the photosensitive drum 7, and a transfer opening 15, which allows the photosensitive drum 7 to face directly the recording medium 2.

Next, the structure of the housing of an embodiment of the process cartridge B according to the present invention will be described. This process cartridge B in accordance with the present invention is assembled in the following manner. First, the toner chamber frame 11 and developing chamber frame 12 are joined. Then, the cleaning means frame 13 is rotatively attached to the structure formed by joining the preceding two frame portions, completing thereby a cartridge housing. Next, the aforementioned photosensitive drum 7, charging roller 8, developing means 9, cleaning means 10 and the like are disposed within the housing to complete the process cartridge B. The process cartridge B is removably installed in a cartridge installing means provided within the apparatus main assembly 14.

Structure of Housing of Process Cartridge B

The housing of the process cartridge B according to the present invention is constructed by joining the toner chamber frame 11, developing chamber frame 12, and cleaning means frame 13, and its structure will be described below.

Figure 9:
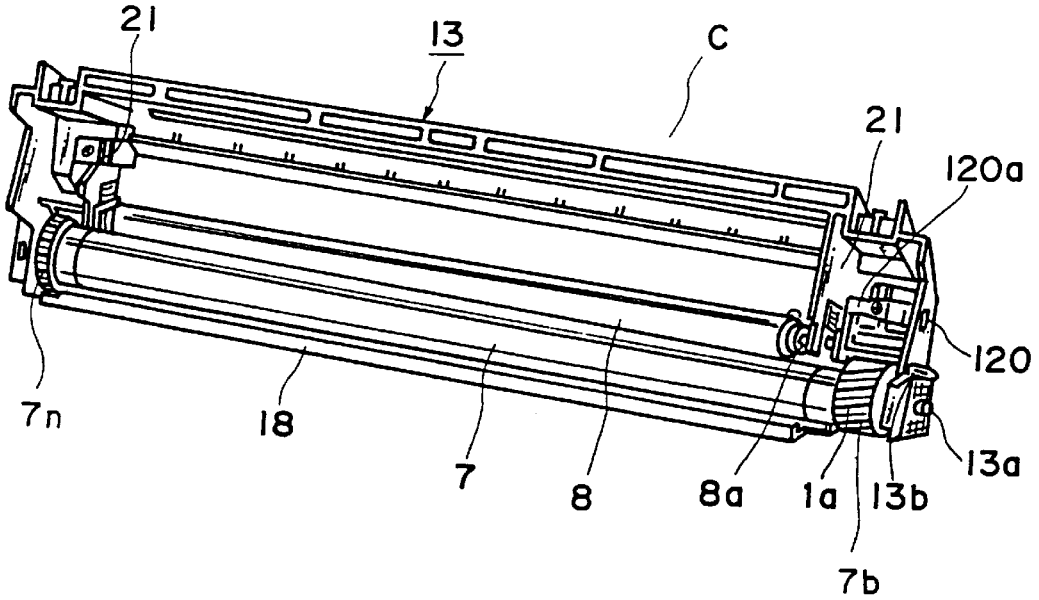
FIG. 9(*a*) is a perspective external view of the cleaning unit of the process cartridge illustrated in FIG. 1, and FIG. 9(*b*) is a perspective external view of the developing unit of the process cartridge illustrated in FIG. 1.
Figure 9:
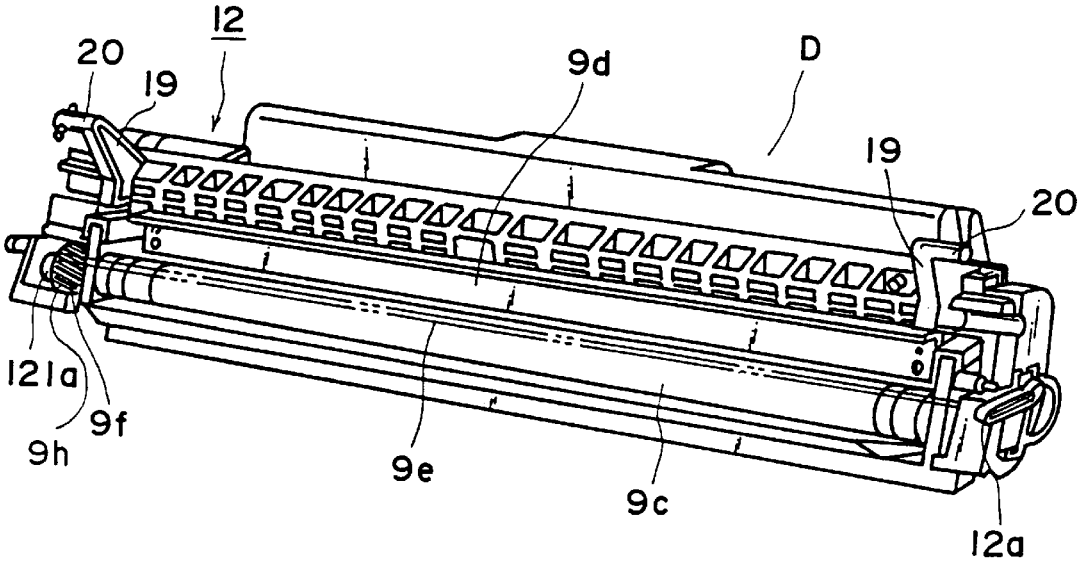

Referring to FIGS. 3 and 9, the toner chamber frame 11 comprises a toner storing container portion 9*a,* in which the toner sending member 9*b* is mounted. The developing roller 9*c* and developing blade 9*d* are mounted on the developing chamber frame 12, and the stirring member 9*e,* which circulates the toner within the developing chamber, is rotatively mounted adjacent to the developing roller 9*c*. The aforementioned toner chamber frame 11 and developing chamber frame 12 are melt-welded (by the ultrasonic welding in this embodiment) to form a developing unit D as an integral second frame member (refer to FIG. 9(*b*)).

The photosensitive drum 7, charging roller 8, and cleaning means 11 are mounted on the cleaning means frame 13. Further, a drum shutter member 18, which covers and protects the photosensitive drum 7 when the process cartridge B is out of the apparatus A main assembly, is attached to the cleaning means portion 13 of the frame to form a cleaning unit C as the first frame member (refer to FIG. 9(*a*)).

Then, the developing unit D and cleaning unit C are joined with a joining member 22 to complete the process cartridge B. More specifically, referring to FIG. 9, an axis 20 is provided at the end of an arm portion 19 formed at each of the longitudinal ends of the developing chamber portion 12 of the frame (refer to FIG. 9(*b*)). On the other hand, a recessed portion 21, in which the axis 20 is fitted to fix the positional relationship between the developing D and cleaning unit C, is provided at each of the longitudinal ends of the cleaning means portion 13 of the frame (refer to FIG. 9(*a*)). The joining member 22 is mounted on the cleaning means portion 13 of the frame by inserting the axis 20 into the recessed portion 21, whereby the developing and cleaning units D and C are joined in a manner so as to pivot relative to each other about the axis 20, allowing thereby the developing roller 9*c* to be pressed toward the photosensitive drum 7 due to the weight of the developing unit D itself. Also, the joining member 22 is provided with a compression spring 22*a,* so that the developing chamber frame 12 is pressed downward to reliably press the developing roller 9*c* toward the photosensitive drum 7. Further, a spacer ring 9*f* is provided at each of the longitudinal end portions of the developing roller 9, wherein this ring 9 is pressed on the photosensitive drum 7 to keep a predetermined distance (approximately 300 $\mu$m) between the photosensitive drum 7 and developing roller 9*c*.

As for the connection between the developing unit D and cleaning unit C with the use of the joining member 22, it has been disclosed in a Laid-Open Japanese Patent Application No. 18920/1992 (Laid-open on Oct. 29, 1992).

Structure of Guiding Means of Process Cartridge B

Next, guiding means, which guides the cartridge B when the cartridge B is installed into the apparatus A main assembly or removed therefrom, will be described referring to FIGS. 4–9, wherein FIG. 5 is a right-hand side view of the cartridge B relative to the direction of an arrow mark X, in which the cartridge B is inserted into the apparatus A main assembly (right-hand side as seen from the developing unit D side), and FIG. 6 is a left-hand side view of the same.

As is evident from the drawings, the guiding means, which serves as a guide when the process cartridge B is inserted into the apparatus main assembly 14 or removed therefrom, is provided on each of the longitudinal end surfaces of the housing 100. This guiding means comprises a doweled portion 13*a* as a first guiding member, a long guide 12*a* as a second guiding member, and s short guide 13*b* as a third guiding member.

The projection or doweled portion 13*a* is a cylindrical member for rotatively supporting a drum shaft 7*a,* which supports the photosensitive drum 7, and is provided on each of the lateral surfaces of the cleaning means frame 13. The long guide 12*a* is provided on each of the longitudinal end surfaces of the developing chamber frame 12, and bridges the surfaces of the developing chamber frame 12 and cleaning means frame 13. The short guide 13*b* is provided on each of the longitudinal end surfaces of the cleaning means frame 13, above the doweled portion 13*a*.

The long guide 12*a* extends in the direction (arrow X direction), in which the cartridge B is inserted, and its angle is set to be substantially equal to an angle at which the process cartridge B is inserted. The doweled portion 13*a* is disposed so as to be fallen in the path of the imaginary extension of the long guide 12*a* in the cartridge inserting direction, and the short guide 13*b* is substantially parallel to the long guide 13*a*. The doweled portion 13*a,* second guide member 12*a,* third guide member 13*b* are also provided on the longitudinal side surface opposite to the one illustrated in FIG. 10, and their configuration and positions are the same as those shown in FIG. 10. These three guiding members project substantially the same distance from the cleaning means frame 13 and developing chamber frame 12, which are in the same plane.

Hereinafter, more detailed description will be given.

The doweled portion 13 is the first guiding member and is provided on each of the lateral surfaces C1 (right-hand side 13*c*) and C2 (left-hand side 13*d*) of the cleaning unit C, wherein the side Cl is the right-hand side portion 13*c* of the cleaning means frame 13 relative to the axial direction of the photosensitive drum 7, as the cartridge B is seen from the developing unit D side (as the cartridge B is seen from the downstream side of the cartridge B inserting direction). The other side C2 is the left-hand side portion of the cleaning means frame 13, relative to the axial direction of the photosensitive drum 7. This doweled portion 13*a* is a cylindrical member, which projects from each of the longitudinal end surfaces 13*c* and 13*d* of the cleaning means frame 13 in the axial direction of the photosensitive drum 7. The drum shaft 7*a* is supported by this cylindrical member 13*a,* which fits around the drum shaft 7*a*. In other words, the drum shaft 7*a* is guided by the guiding member 16*a,* which will be described later, with the cylindrical member 13*a* being interposed, and then, the position of the drum shaft 7*a* is fixed by a groove 16*a*5.

The long guide 12*a* as the second guide member is provided on each of the longitudinal end surfaces D1 (right-hand portion 12*c*) and D2 (left-hand side 12*d*) of the developing unit D, wherein one surface, D1, of the lateral portion is the right-hand portion 12*c,* relative to the axia direction of the photosensitive drum 7, of the developing chamber frame portion 12, and the other surface, D2, is the left-hand side portion 12*d* relative to the axial direction of the photosensitive drum 7 of the developing chamber frame portion 12. The long guide 12*a* is disposed away from the cylindrical member 13*a,* being on the upstream side of the cylindrical member 13*a,* relative to the cartridge inserting direction (arrow X direction). More precisely, the long guide 12*a* is disposed within a region 1 formed between the top and bottom imaginary lines 11 and 12 (FIG. 5) extending parallel in the inserting direction and tangentially from the peripheral surface of the cylindrical member 13*a*. This long guide 12*a* bridges between the developing chamber frame portion 12 and cleaning means frame portion 13, with its inserting end portion 12*a*1 extending over the lateral surface area of the cleaning frame portion 13 (by an approximate distance of 1 mm to 3 mm).

The short guide 13*b* as the third guiding member is provided on the lateral surfaces 13*c* and 13*d* of the cleaning unit C, above the cylindrical member 13*a*. More specifically, the short guide 13*b* is substantially directly above the cylindrical member 13*a* as seen from the cartridge inserting direction. In other words, the short guide 13*b* is disposed within the region 15 formed between two parallel lines 13 and 14, which are drawn in such a manner as to be tangent to the peripheral surface of the cylindrical member 13*a* and substantially perpendicular to the cartridge inserting direction (arrow X direction). In addition, the short guide 13*b* is substantially parallel to the long guide 13*a*.

Here, typical measurements of the guiding members will be listed.

The first guide member 13*a* is approximately 10.0 mm in diameter (tolerable range of 7.5 mm to 10.0 mm); the second guide member 12*a,* approximately 36.0 mm in length (tolerable range of 15.0 mm to 41.0 mm) and approximately 8.0 mm in width (tolerable range of 1.5 mm to 10.0 mm); and short guide 13*b* is approximately 10.0 mm in length (tolerable range of 3.0 mm to 17.0 mm) and approximately 4.0 mm (tolerable range of 1.5 mm to 7.0 mm) in width. Further, the distance between the peripheral surface of the first guide member 13*a* and the inserting end portion 12*a*1 of the second guiding member 12*a* is approximately 9.0 mm.

The distance between the peripheral surface of the first guiding member 13*a* and the bottom end tip 13*b*1 of the third guiding member 13*b* is approximately 7.5 mm (tolerable range of 5.5 mm to 9.5 mm).

Next, a regulatory contact portion 13*e* and a disengagement contact portion 13*f,* which are provided on the top surface 13*d* of the cleaning unit C, will be described. Here, the top surface means such a portion of the leaning unit C surface that is going to face upward when the process cartridge B is installed into the apparatus A main assembly. In this embodiment, it is the top surface 13*i* of the cleaning unit C.

The regulatory contact portion 13*e* and disengagement contact portion 13*f* are provided on each of the lateral end portions 13*c* and 13*d* of this surface 13*i*. This regulatory contact 13*e* fixes the position of the process cartridge B in the apparatus A main assembly. More specifically, when the process cartridge B is inserted into the apparatus A main assembly, the contact 13*e* comes in contact with a fixing member 25 provided on the apparatus A main assembly (FIGS. 10–17), whereby the position of the process cartridge B is regulated. The disengagement contact portion 13*f* displays its function when the process cartridge B is removed from the apparatus A main assembly. More specifically, when the process cartridge B is taken out of the apparatus A main assembly, it comes in contact with the fixing member 25 to permit a moment to function to smoothly remove the cartridge B. The steps for installing or removing the process cartridge B will be described later with reference to FIGS. 10–17.

Describing in more detail, a recessed portion 13*g* is provided on the cleaning unit C, on the top surface 13*i* of the cleaning unit C, at each of the lateral edges relative to the cartridge inserting direction. This recess portion 13*g* is provided with: the first slanted surface 13*g*1, which extends upward toward the rear from the leading end of the cartridge B relative to the inserting direction (arrow X direction); the second slanted surface 13*g*3, which extends downward toward the rear from the top end 13*g*2 of the slanted surface 13*g*3; and the fourth slanted surface 13*g*5, which extends further downward toward the rear from the bottom end 13*g*4 of the slanted surface 13*g*3. At the bottom end 13*g*6 of the slanted surface 13*g*5, a wall 13*g*7 is provided. The second slanted surface 13*g*3 corresponds to the regulatory contact portion 13*e,* and the wall 13*g*7 corresponds to the disengagement contact portion 13*f*.

Here, the typical measurements of the portions described above will be listed.

The regulatory contact portion 13*e* is angled by 0 degree relative to the horizontal direction 1 of the cartridge B in the apparatus A main assembly, and is approximately 6.0 mm in length (tolerable range of 4.5 mm to 8.0 mm). The disengagement contact portion 13*f* is slanted by θ1 (approximately 45 degrees) relative to the horizontal direction 1, and is approximately 10.0 mm in length (tolerable range of 8.5 mm to 15.0 mm).

Next, the steps for installing the process cartridge B into the apparatus A main assembly, or removing it therefrom, will be described with reference to FIGS. 10–19.

Let it be assumed that the process cartridge B structured as described above can be installed into the cartridge accommodating means provided within the apparatus A main assembly, and can be removed therefrom.

Figure 17:
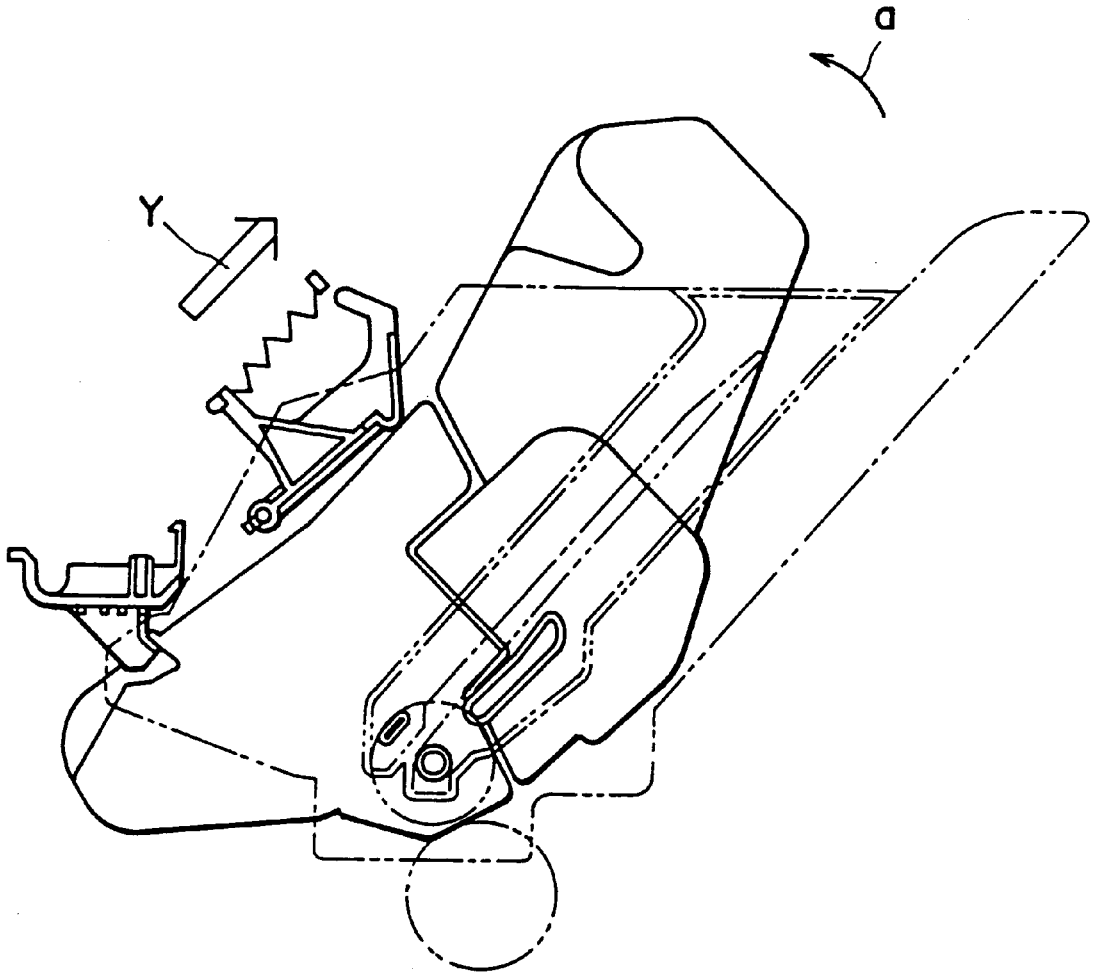
Figure 18:
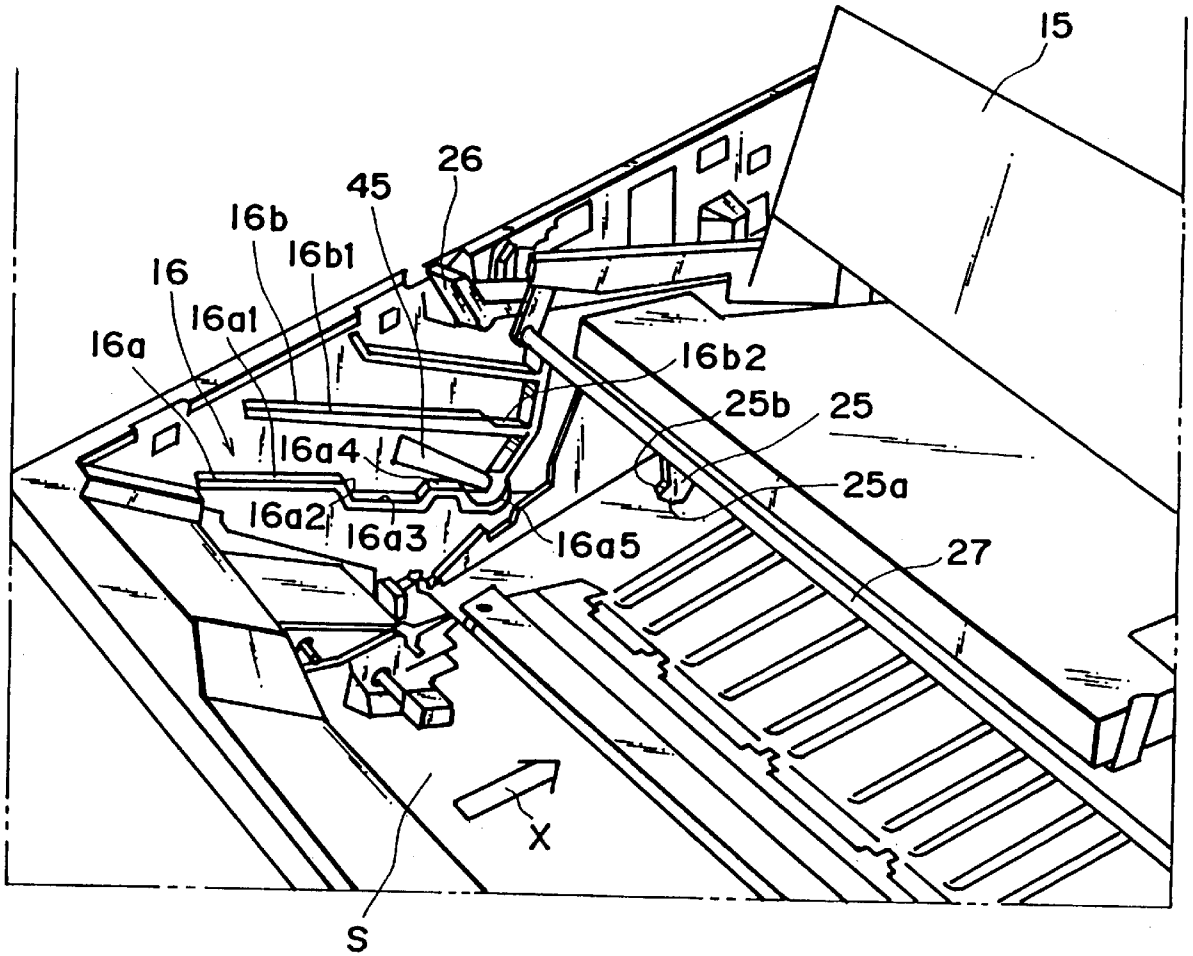
FIG. 18 is a perspective view of a portion of the interior of the apparatus main assembly.
Figure 19A:
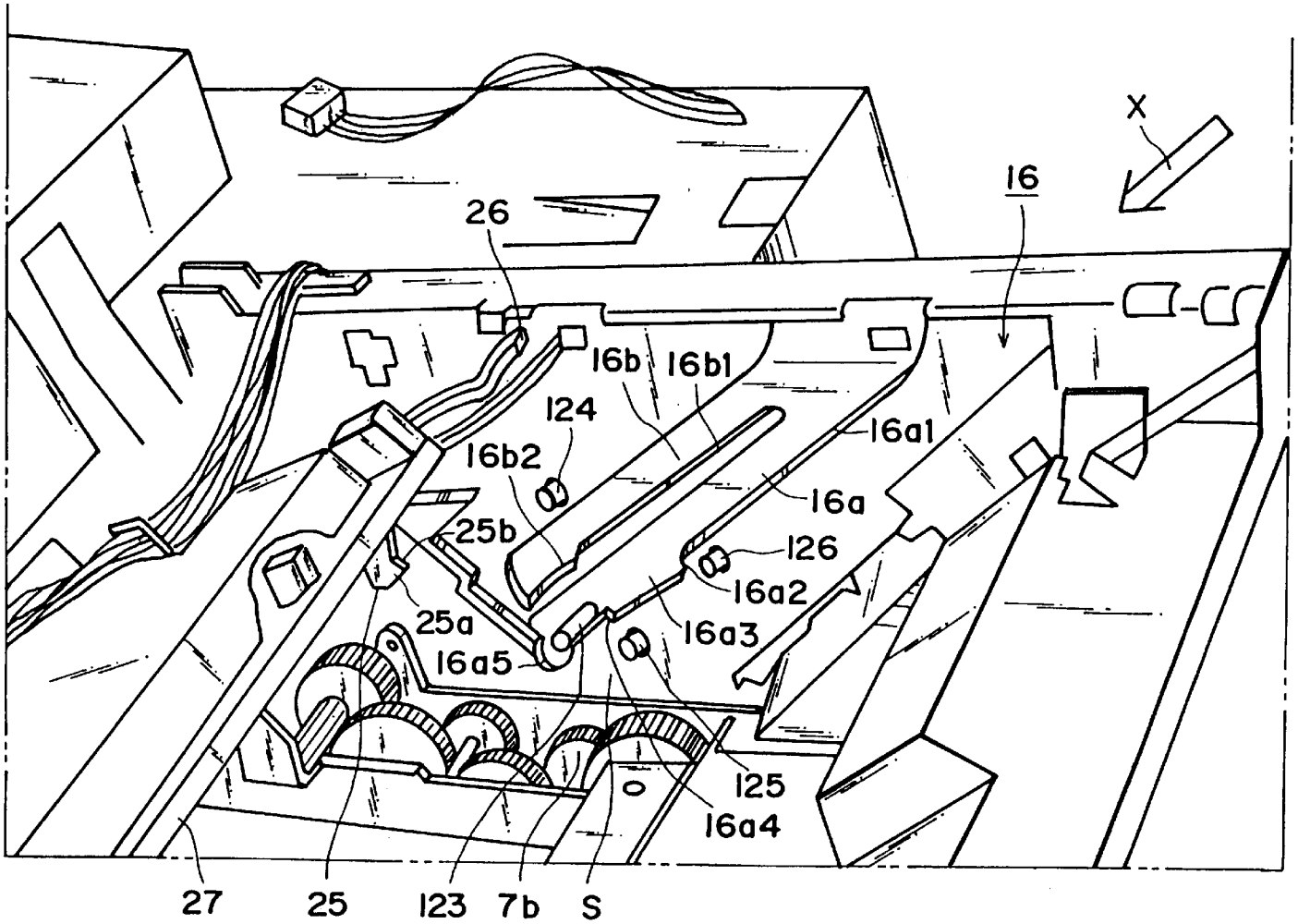
FIG. 19(*a*) is a perspective view of a different portion of the interior of the apparatus main assembly, and FIG. 19(*b*) is a side view of another interior portion of the apparatus main assembly.
Figure 19B:
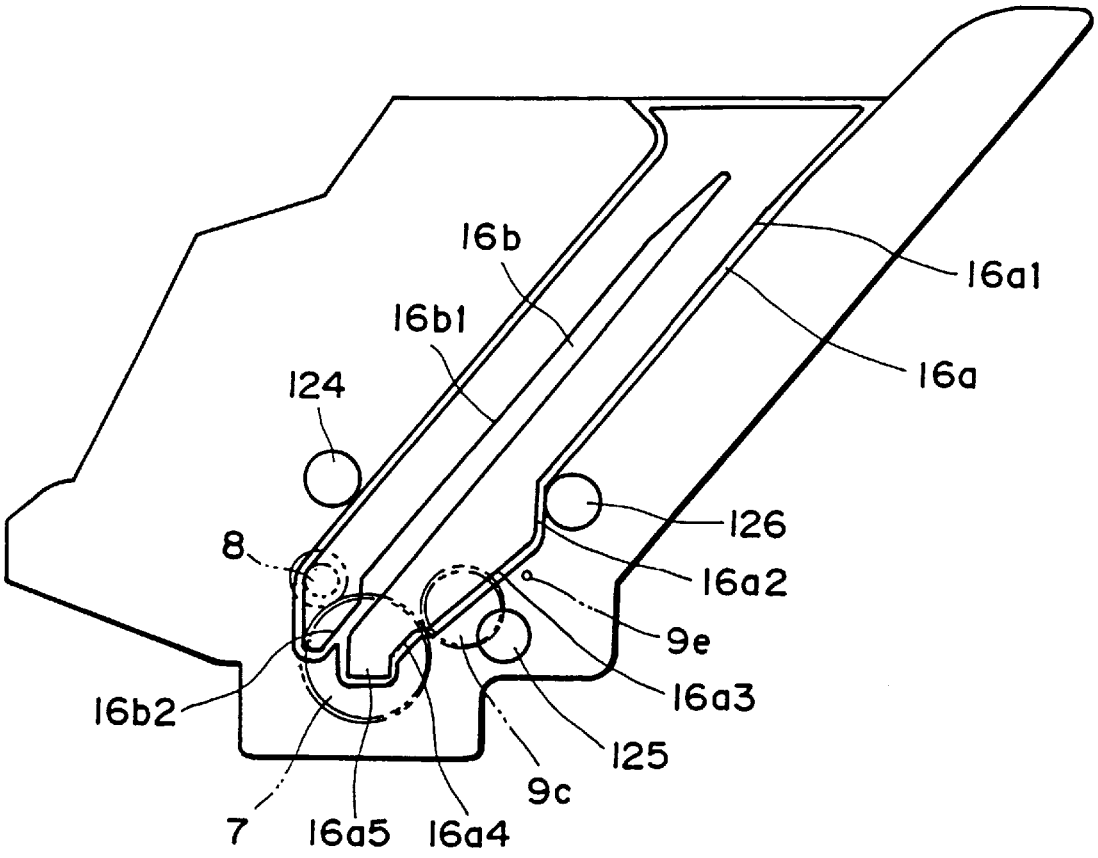

Referring to FIGS. 18 and 19, as an operator opens a pivotal cover 15, a cartridge accommodating space S, and left and right cartridge installation guides 16, which are mounted on the corresponding sides of the apparatus A main assembly, are exposed. Each of the cartridge installation guides 16 comprises a pair of guide portions of its own, that is, a first guide portion 16*a* and a second guide portion 16*b,* which correspond to the same on the opposite side. The installation of the process cartridge B into the apparatus A main assembly is accomplished by inserting the process cartridge B along the guide portions 16*a* and 16*b* and closing the cover 15. As for the inserting direction of the cartridge B, it is a direction which intersects with the axial line of the photosensitive drum 7; more specifically, such a direction that is substantially perpendicular to the axial line of the photosensitive drum 7 as illustrated in FIGS. 10–17. In this case, the cleaning unit C side is the leading side and the developing unit D side is the tailing side.

A recessed portion 17 is provided on the cartridge B, which makes it easier for an operator to hold it during its installation or removal (see FIG. 3).

Further, the process cartridge B comprises a drum shutter 18 (see FIG. 3), the movement of which is linked to the movement of the cartridge B during its installation or removal. When the cartridge B is removed from the apparatus A main assembly, the shutter 18 is closed to protect the portion of the photosensitive drum 7 which faces the transfer opening. The shutter 18 is supported by an arm 18*a,* and the pivotal cover 15 pivots about a pivotal point 15*a* (FIG. 1).

The first guide portion 16*a* is the bottom portion of the guide member 16, and guides the long guide 12*a* and cylindrical member 13*a* provided on the process cartridge B side. This first guide portion 16*a* comprises a main guide portion 16*a*1, a stepped portion 16*a*2, a recessed portion 16*a*3, an auxiliary guide portion 16*a*4, and a positioning groove 16*a*5, which are disposed in this order from the upstream side toward the downstream relative to the inserting direction. The main guide portion 16*a*1 guides the long guide 12*a* and cylindrical member 13*a*. The auxiliary guide portion 16*a*4 guides the cylindrical member 13*a* into the positioning groove 16*a*5. The positioning groove 16*a*5 is where the cylindrical member 13*a* is fitted to regulate the position of the cartridge B in the apparatus A main assembly. The second guide portion 16*b* is the upper portion of the guide member 16, and comprises a slanted surface 16*b*1 and a recess 16*b*2, which are disposed in this order from the upstream side toward the downstream relative to the inserting direction.

Further, in the cartridge accommodating space S of the apparatus A main assembly, a fixed member 25 (member for regulating the rotation) is provided on the left and right sides. It is fixed to a stay 27. This fixed member 25 comes in contact with the aforementioned regulatory contact portion 13*e* to regulate the clockwise rotation of the cartridge B. More specifically, the cartridge B is accurately positioned in the apparatus A main assembly as the cylindrical member 13*a* fits into the groove 16*a*5 and the regulatory contact 13*e* comes in contact with the fixed member 25. Further, when the cartridge B is taken out, the fixed member 25 comes in contact with the disengagement contact portion 13*f* to facilitate the smooth removal of the cartridge B.

Further, in the cartridge accommodating space S, a pressing member 26 is disposed on the left and right sides. This pressing member 26 pressed in the clockwise direction by the elastic force of a coil spring 26*a* is rotatable about a fulcrum 26*b,* and elastically presses the top surface of the cartridge B, whereby the cartridge B is prevented from being vibrated when the apparatus A is subjected to vibration or the like.

Figure 10:
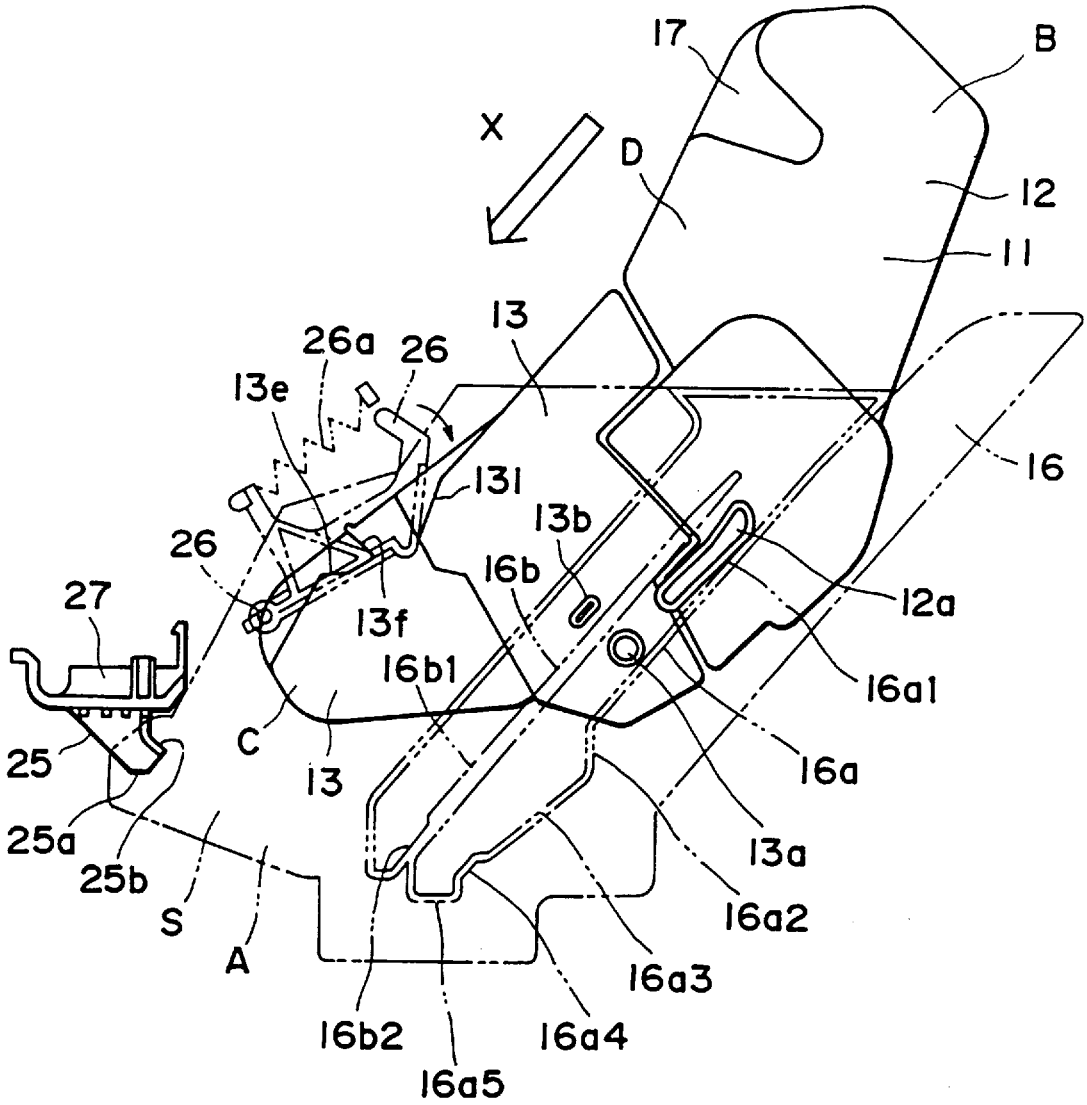
FIGS. 10–17 are side views, which depict steps for installing the process cartridge illustrated in FIG. 1 into the main assembly of the image forming apparatus, or removing it therefrom.

Next, the relationship between the installation guide 16 provided on the apparatus A main assembly and the guide members 12*a,* 13*a* and 13*b* provided on the cartridge B, during the installation or removal of the cartridge B, will be described with reference to the drawings. FIGS. 10–15 are schematic drawings, which depict the steps for installing the process cartridge B from the beginning of the cartridge installation to the moment when the process cartridge B is finally positioned in a predetermined location. In FIGS. 10 and 15, the full side view of the process cartridge B is depicted with a solid line, and the installation guide member of the apparatus main assembly is depicted with a double dot chain line (imaginary line). In FIGS. 11–14, which depict intermediary steps of the cartridge installation, only the guide members of the process cartridge B are depicted with solid lines, and the other portions are depicted with the double dot chain lines.

First, referring to FIG. 10, at the beginning of the cartridge B installation into the apparatus A main assembly, the cylindrical member 13*a* and long guide 12*a* of the cartridge B are guided by the guide portion 16*a* in such a manner as to slide thereon. At this moment, the short guide 13*b* is not guided by the guide portion 16*a,* being away from it by a predetermined distance 1 (in this embodiment, approximately 2.0 mm to 4.0 mm).

Also at this moment, the pressing member 26 rotates upward following the slanted surface 13*i* provided on the top surface of the cartridge B, so that it does not interfere with the cartridge installation. As the cartridge B is being further inserted, the pressing member 26 keeps on sliding on the top surface of the cartridge B, checking thereby the upward movement of the cartridge B. Even after the cartridge B has been installed in the apparatus A, the pressing member 26 keeps on pressing on the top surface of the cartridge B as long as the cartridge B is in the apparatus A.

Figure 11:
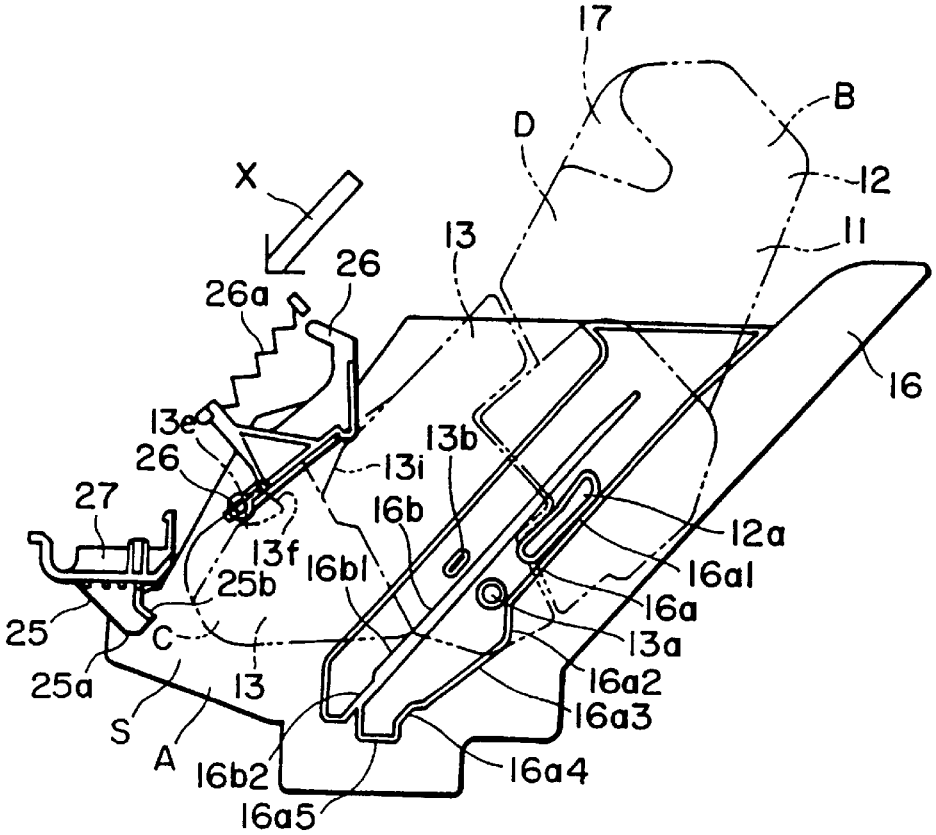

Next, when the process cartridge B has been further inserted and is in the state depicted in FIG. 11, the cylindrical member 13*a* is ready to pass the stepped portion 16*a*2 provided on the first installation guide portion 16*a* and to move onto the recess portion 16*a*3 provided also on the first installation guide portion 16*a*. This recessed portion 16*a*3 of the guide portion 16*a* is to let go the long guide 12*a* when the process cartridge B is inserted to a predetermined point (FIG. 15), and its depth m (in this embodiment, approximately 4.0 mm to 8.0 mm) is set to be larger than the aforementioned distance 1 (1<m). It should be noted that at this moment, the short guide 13*b* is not in contact with the second guide portion 16*b* (16*b*1).

Figure 12:
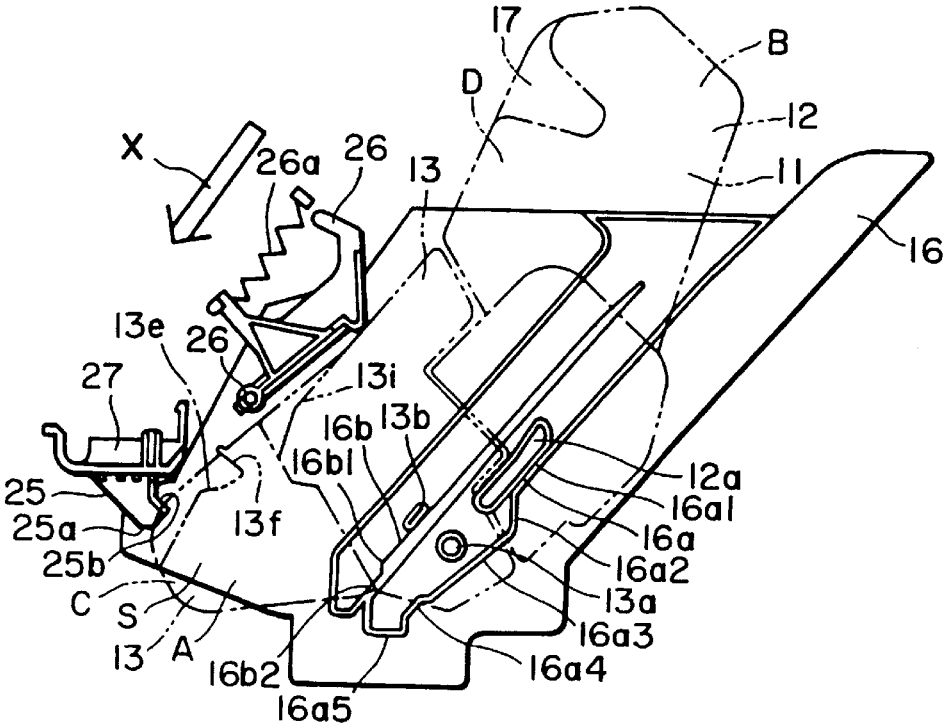

Next, as the process cartridge B is further inserted till the state depicted in FIG. 12 is realized, the short guide 13*b* makes contact with the guide portion 16*b* before the cylindrical member 13*a* of the cartridge B reaches the bottom of the recessed portion 16*a*3. In other words, at this time, both the long and short guides 12*a* and 13*b* serve as the insertion guide, whereby the shock, which might be imparted on the cartridge B by the stepped portion or the like, is reduced.

Figure 13:
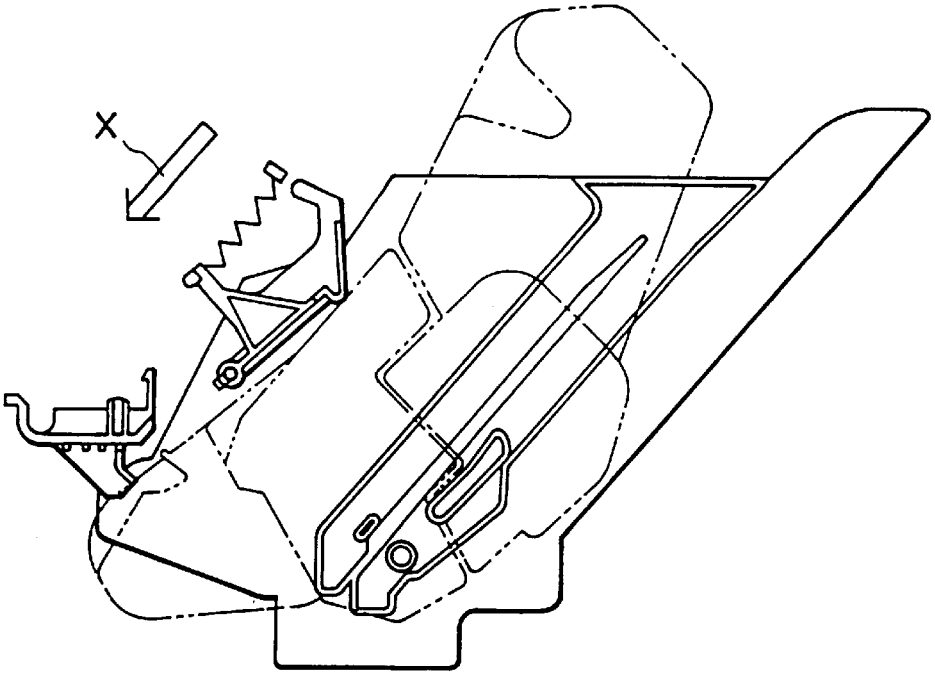

As the process cartridge B is further inserted, the state illustrated in FIG. 13 is realized. In this state, the trailing end of the long guide 12*a* of the process cartridge B is at the edge of the recessed portion 16*a*3 of the first guide portion 16*a,* and the cylindrical member 13*a* of the process cartridge B is in contact with the auxiliary guide portion 16*a*4, being ready to follow the guide portion 16*a*4. Next, the cylindrical member 13*a* and short guide 13*b* of the process cartridge B are guided by the first guide portion 16*a* and second guide portion 16*b,* respectively (FIG. 14).

Figure 14:
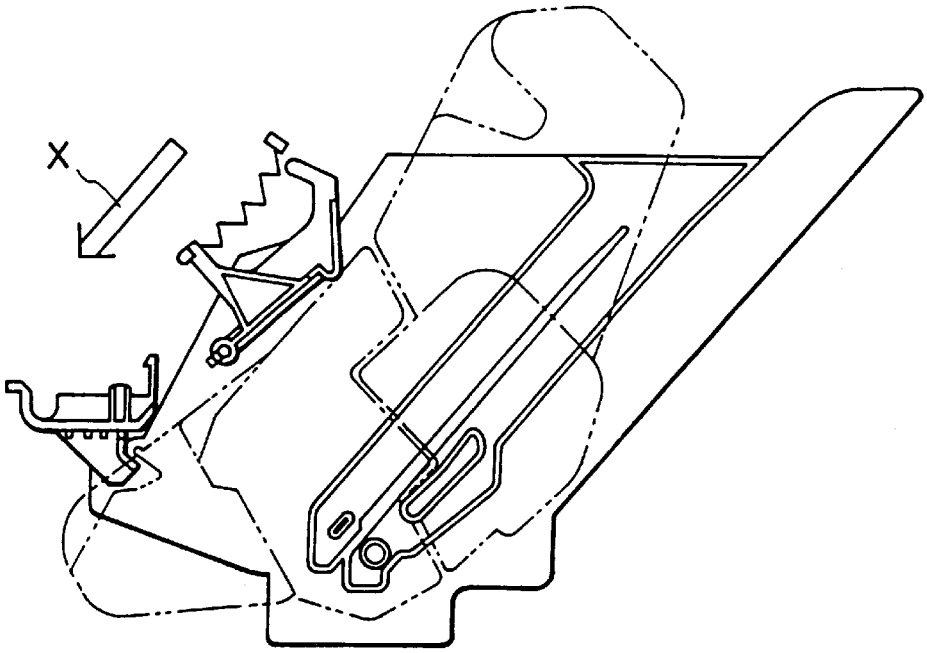
Figure 15:
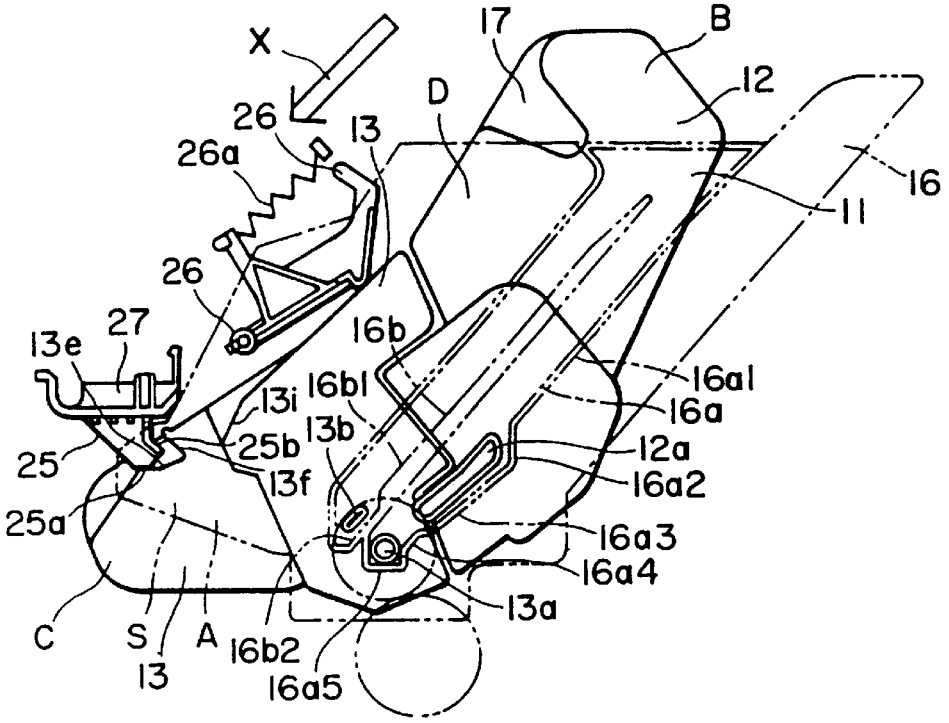

Next, as the cartridge B is further inserted and the state illustrated in FIG. 14 is realized, the short guide 13*b* comes to the recessed portion 16*b*2 of the second guide portion 16*b*. For a short period in which this short guide 13*b* drops into the recessed portion 16*b*2, only the cylindrical member 13*a* is in contact with the apparatus A main assembly, at the auxiliary guide portion 16*a*4; therefore, the process cartridge B slightly rotates in the counterclockwise direction, and lastly, the cylindrical member 13*a* drops into the groove 16*a*5 of the guide portion 16*a* (FIG. 15). At substantially the same time, the regulatory contact portion 13*c* provided on the cleaning means frame portion 13 comes in contact with the rotation regulating portion 25*a* (FIG. 15) of the fixed member 25 fixed to the apparatus A main assembly. As a result, the overall position and orientation of the process cartridge B within the apparatus A is fixed. In this state, the position of the process cartridge B is fixed by a single point, that is, the center (cylindrical member 13*a*) of the process cartridge B, and the other guides (long and short guides 12*a* and 13*b*) are not in contact with any portion of the installation guide member 16 of the apparatus A main assembly; therefore, the position of the cartridge B is accurately fixed.

The positional relationship between the regulatory contact portion 13*e* and rotation regulating portion 25*a* is such that the moment, which is generated on the process cartridge B as the process cartridge B is driven, is received by the contact between regulatory contact portion 13*e* and rotation regulating portion 25*a.* The distance between the regulatory contact portion 13*e* and the center of the cylindrical member 13*a,* and the distance between the rotation regulating portion 25*a* and the center of the cylindrical member 13*a* are longer than the distance between the long guide 12*a* and the center of the cylindrical member 13*a* and the distance between the short guide 13*b* and center of the cylindrical member 13*a*. Therefore, the orientation of the process cartridge B remains more stable when the process cartridge B is driven.

Figure 21:
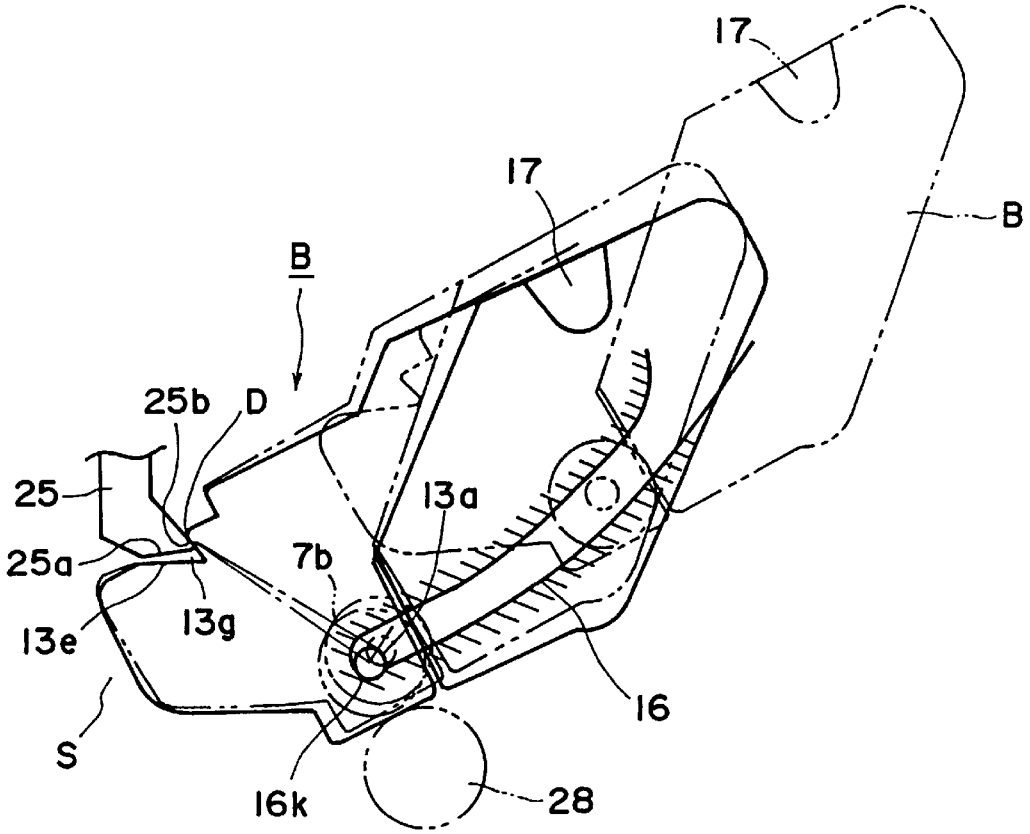

In a state shown in FIG. 21, a helical gear 7*b* provided on the photosensitive drum 7, at one of the axial ends, engages with a driving helical gear 28 provided on the apparatus A side. Thus, the driving force is transmitted from the apparatus A main assembly to the photosensitive drum by way of the gears 28 and 7*b,* wherein as the driving force is transmitted from the gear 28 to gear 7*b,* the cartridge B is subjected to a force that works in the clockwise direction. However, the movement generated on the cartridge B is regulated by the contact portion 13*e*.

The pressing member 26 presses down the process cartridge B from above. Therefore, even if the cylindrical member 13*a* fails to drop into the groove 16*a*5 of the main A assembly, a moment is generated about the contact point between the rotation regulating portion 25*a* and contact portion 13*e,* whereby the cylindrical member 13*a* is caused to drop into the groove 16*a*5.

Next, referring to FIGS. 16 and 17, the steps for taking the process cartridge B out of the apparatus A will be described. In the drawing, the direction indicated by an arrow Y is the direction in which the process cartridge B is removed.

Figure 16:
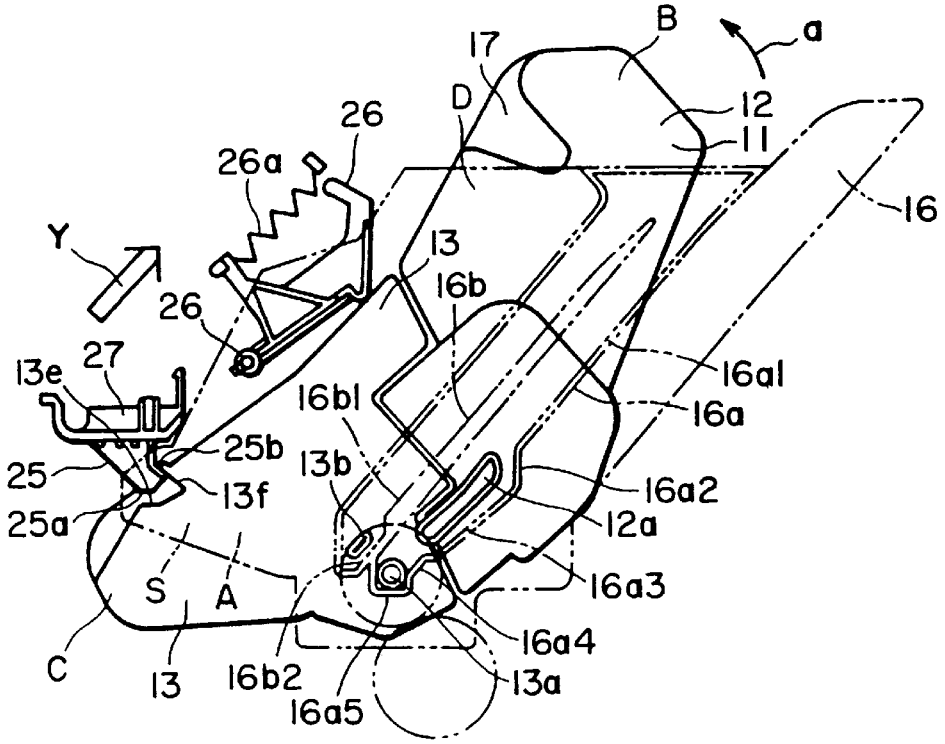

Referring to FIG. 16, when the process cartridge B is to be removed from the apparatus A, the operator grabs a handle portion 17 (to provide the handle, recessed portions, are formed on the cartridge B) and lifts the cartridge B by the handle portion 17 (direction of an arrow a), whereby the process cartridge B is rotated counterclockwise about the cylindrical member 13*a*. As a result, the regulatory contact portion 13*f* of the process cartridge B makes contact with the disengagement contact portion 25*b* of the fixed member 25 provided on the apparatus A main assembly. As the process cartridge B is further lifted, it is rotated about the contact point D between the regulatory contact portion 13*f* and disengagement contact portion 25*b*. As a result, the cylindrical member 13*a* is lifted out of the groove 16*a*5. At this moment, the engagement between the drum gear 7*b* and driving gear 28 is broken. In this state, the process cartridge B can be pulled straight out of the apparatus A, following the steps depicted in FIGS. 14, 13, 12, 11 and 10 in that order. As will be understood, the recessed portions are advantageous to facilitate the grabbing action.

As described above, according to this embodiment, the long guide as the second guide member is extended in the cartridge inserting direction in such a manner as to bridge the lateral surfaces of the developing unit D and cleaning unit C; therefore, the process cartridge is prevented from wobbling during the installation or removal. As a result, the cartridge installation becomes more reliable, which improves the operational efficiency.

The guiding means, which serves as the guide when the process cartridge is inserted into the apparatus main assembly or removed therefrom, is constituted of three guide members: cylindrical member 13*a,* long guide 12*a,* and short guide 13*b,* and the process cartridge B is guided by at least two guides during its installation or removal; therefore, even if there is a stepped portion or the like on the installation guide members of the apparatus main assembly, the shock, to which the process cartridge might be subjected, is cushioned.

The position of the process cartridge is fixed by the rotation regulating portion 25*a* oriented to control the moment, which is generated on the cartridge as the cartridge is driven and the cylindrical member 13*a*. However the other guides (long and short guides 12*a* and 13*b*) remain in non-contact with the guide members of the apparatus main assembly; therefore, the orientation of the process cartridge B remains more stable while the image forming apparatus is driven (during the image formation).

As for the guiding means for installing or removing the cartridge, the embodiment described above exemplifies a guiding means comprising three guide members positioned at different locations. However, the present invention is not limited to this example, but instead, it may be a guiding means comprising at least a cylindrical member as the first guide member, and a long guide as the second guide member, or a guiding means comprising an additional guide member or guide members besides the three mentioned above. Such an arrangement can also stabilize the cartridge during the installation or removal, and improves the operational efficiency.

Next, referring to FIGS. 20 and 21, a series of steps other than the aforementioned ones for installing or removing the process cartridge B will be described, wherein a member with the same function as the one in the preceding embodiment is given the same reference, and the description thereof is omitted for simplicity.

Figure 20:
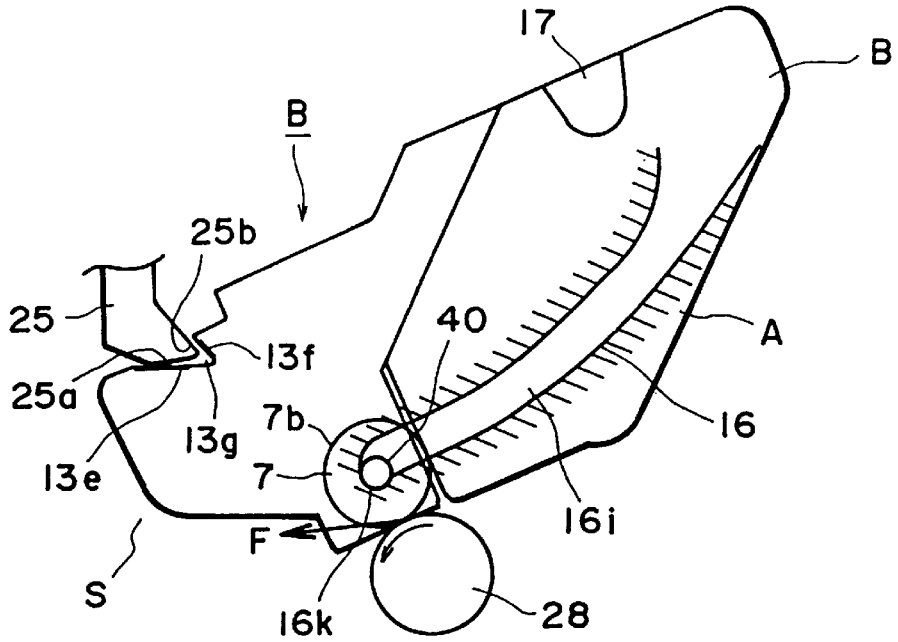
FIGS. 20 and 21 are side views of different process to which the first embodiment of the present invention has been applied.

In this embodiment, the process cartridge B comprises a pair of shafts 40 as positioning portions, which project from the corresponding lateral surfaces of the cartridge frame in line with the rotational axis 7*a* of the photosensitive drum 7*a* (FIG. 20 shows only one side), and also, guide members 16, which are disposed on the corresponding left and right sides. The guide member 16 is provided with a guide groove 16*i,* which extends diagonally downward and guides the positioning shaft 40 when the cartridge B is installed. There is a recessed portion 16*k* at the deepest end of the guide groove 16*i*. As the positioning shaft 40 drops into this recessed portion 16*k,* the position of the cartridge B in the apparatus is fixed.

In other words, the position of the process cartridge B in the apparatus A is fixed as it is inserted into the apparatus A, allowing its positioning shafts 40 projecting from the corresponding lateral surfaces of the cartridge frame to follow the corresponding guide grooves 16*i* till the shafts 40 drop into the corresponding positioning recesses 16*k*.

Referring to FIGS. 2 and 21, also in this embodiment, the regulatory contact portion 13*e* and disengagement contact portion 13*f* are on the top portion of the cartridge frame, but the rotation regulating portion 25*a* and disengagement contact portion 25*b* are integrated into a single piece.

In other words, a recessed portion 13*g* is provided on the top surface of the process cartridge B, and two surfaces of this recessed portion 13*g* serve as the regulatory contact portion 13*e* and disengagement contact portion 13*f,* respectively. The image forming apparatus A is provided also with the fixed member 25, which is disposed so as to be above the installed process cartridge B and to fit into the recessed portion 13*g*. Two surfaces of this fixed member 25 serve as the rotation regulating portion 25*a* and disengagement contact portion 25*b*.

With such an arrangement as described above in place, when the process cartridge B is installed into the apparatus A main assembly, the regulatory contact portion 13*e* makes contact with the rotation regulating portion 15*a* as shown in FIG. 20. When the process cartridge B is taken out, the disengagement contact portion 13*f* makes contact with the disengagement contact portion 25*b* as the operator grabs and lifts the cartridge B, whereby the cartridge B is rotated about the contact point D. As a result, the cylindrical member 13*a* is lifted out of the groove 16*a*5, and the engagement between the drum gear 7*b* and driving gear 28 is broken.

Since the fixed member 25 is not in the path of the recording medium, it is unnecessary to be concerned about its interference with the recording medium. Therefore there is no limitation regarding the component positioning.

Further, a single member integrally comprises both the rotation regulating contact portion 25*a* and disengagement contact portion 25*b;* therefore, a more precise component can be produced; the component cost can be reduced; and the positional accuracy can be improved.

Also, this embodiment exemplifies a case in which the fixed member 25 is disposed so as to be positioned above the installed process cartridge B. However, this fixed member 25 may be disposed so as to be positioned on the lateral side of the installed process cartridge B.

Next, referring to FIGS. 22 and 23, another sequence of steps for installing or removing the process cartridge B will be described.

Figure 22:
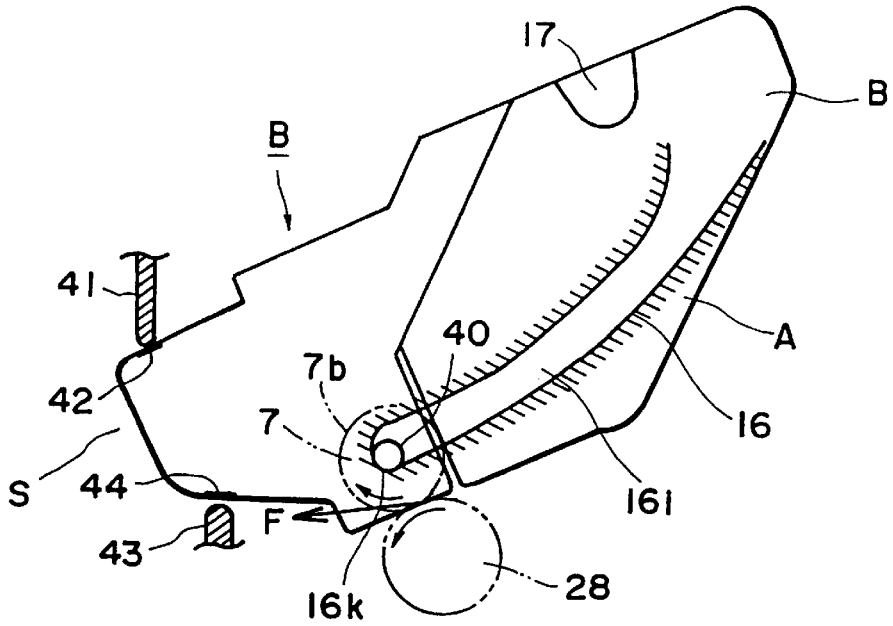
FIGS. 22–25 are side views of different process cartridges to which the first embodiment of the present invention has been applied.

Referring to FIG. 22, in this embodiment, the regulatory contact portion 42 is formed on the top surface of the process cartridge B frame, at the leading end portion relative to the direction in which the process cartridge B is inserted into the image forming apparatus A. This regulatory contact portion 42 makes contact with the rotation regulating portion 41, which will be described later. Also, on the bottom surface of the cartridge B frame, the disengagement contact portion 44 is formed. This disengagement contact portion 44 makes contact with the disengagement projection 43, which will be described later.

Also referring to FIG. 22, the apparatus A comprises: a rotation regulating portion 41, which is disposed in such a manner that as the process cartridge B is inserted along the guide groove 16*i* and the positioning shaft 40 drops into the recessed portion 16*k*, it is positioned above the regulatory contact portion 42; and the disengagement projection 43, which is disposed so as to be positioned below the disengagement contact portion 44.

The process cartridge B comprises the drum gear 7*b*, which is mounted on the rotational shaft 7*a* of the photosensitive drum 7. This drum gear 7*b* engages with the driving gear 28 provided on the apparatus A main assembly, before the positioning shaft 40 of the cartridge B drops into the recessed portion 16*k*. The driving force is transmitted to the photosensitive drum 7 through this engagement. At this time, as the gears 7*b* and 28 engage, a clockwise moment about the positioning shaft 40 is generated on the process cartridge B by a force F exerted by the operator for engaging the gears 7*b* and 28, the regulatory contact portion 42 of the process cartridge B is caused to contact the rotation regulating portion 41 by this moment, whereby the orientation of the process cartridge B is maintained.

Figure 23:
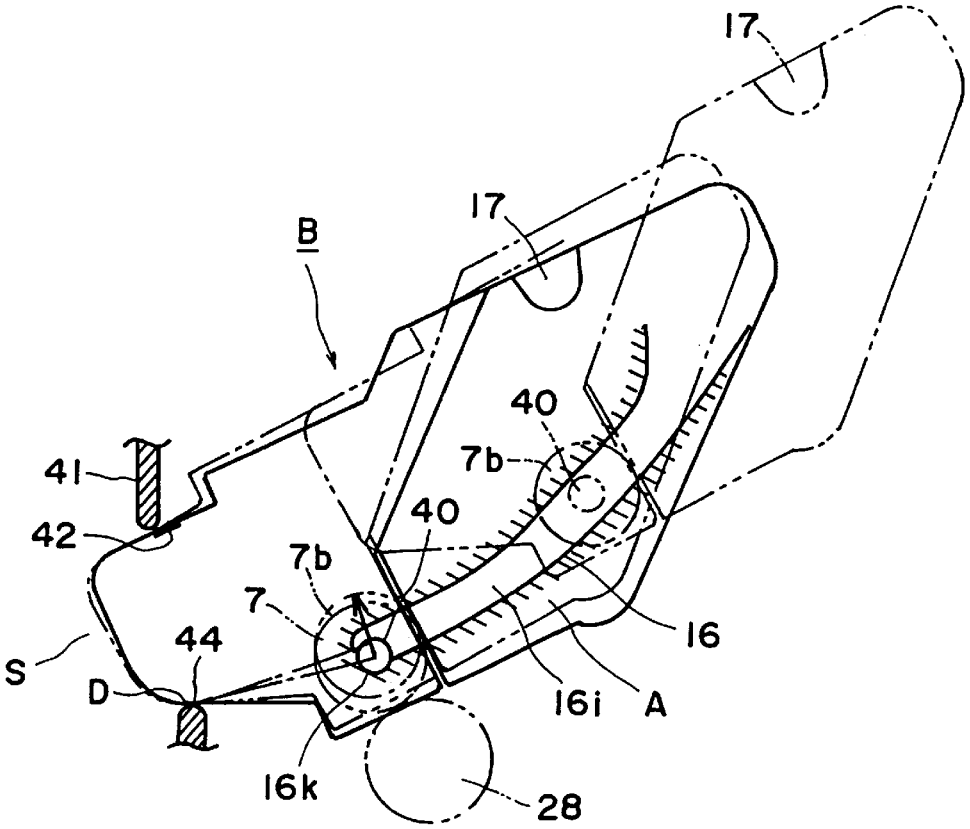

On the other hand, referring to FIG. 23, when the process cartridge B is removed, the operator first grips the handle portion of the cartridge B and pull this portion upward, which causes the process cartridge B to rotate counterclockwise about the positioning shaft 40. As a result, the disengagement contact portion 44 makes contact with the disengagement projection 43. Next, as the operator pulls the process cartridge further upward, the process cartridge B is rotated about the contact point D between the contact portions 44 and 43 this time. In other words, the process cartridge B functions like a lever, the fulcrum of which is the contact point D; therefore, the positioning shaft 40 is lifted out of the positioning recessed portion 16*k*, and at the same time, the engagement between the drum gear 7*b* and driving gear 28 is broken. In this state, the process cartridge B can be pulled straight out of the apparatus A main assembly along the guide groove 16*i*.

When the contact portions 42 and 44 of the process cartridge B, and the rotation regulating portion 41 and disengagement contact portion 43 of the image forming apparatus A main assembly are constructed as described above, the process cartridge B can be properly installed; its orientation can be properly maintained; and also, the gears can be easily disengaged during the cartridge removal.

Next, referring to FIGS. 24 and 25, another sequence of steps for installing or removing the process cartridge B will be described.

Figure 24:
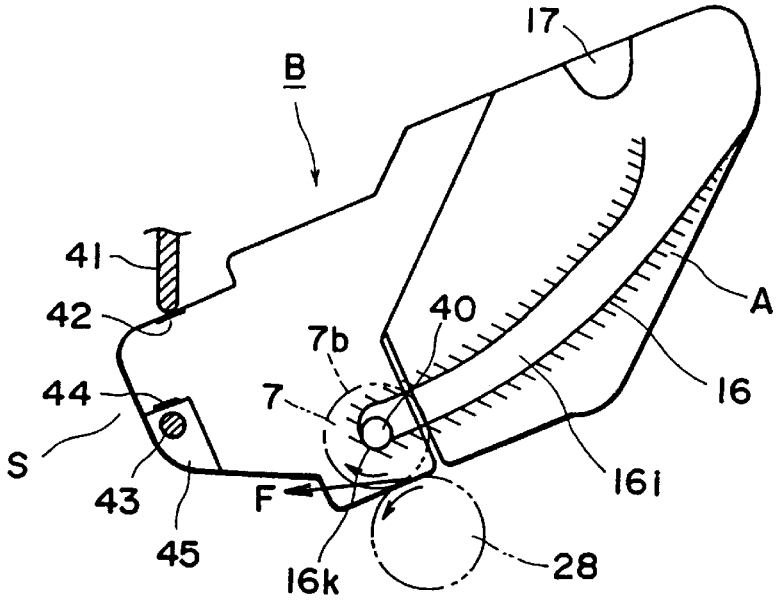
Figure 25:
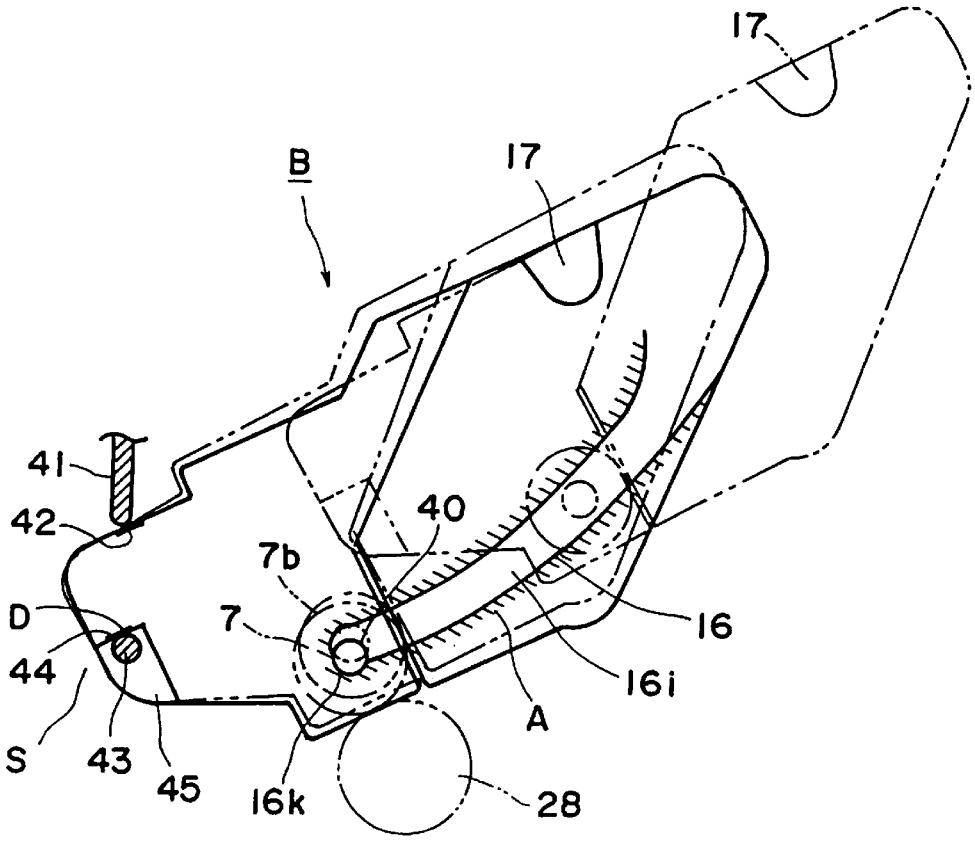

This embodiment depicted in FIGS. 24 and 25 is different from the embodiment depicted in FIGS. 22 and 23 in that the disengagement contact portion 44 of the process cartridge B is disposed to be on the lateral surface of the cartridge frame, and the disengagement contact portion 43 on the image forming apparatus A side, with which this contact portion 44 makes contact, is positioned on the internal lateral surface of the apparatus main assembly.

In other words, a recessed portion 45 is formed on each of the lateral surfaces of the cartridge frame, wherein one surface (the top surface of the recessed portion 45) is used as the disengagement contact portion 44. As for the disengagement contact portion 43, they project into the cartridge accommodating space S from the corresponding predetermined locations on the corresponding lateral walls of the space S.

When such an arrangement as described above is made, not only can the same effects as the preceding embodiments be obtained, but also the number of requirements regarding the component positioning can reduced. More specifically, referring to FIG. 25, the contact portion 44 makes contact with the contact projection 43, and the contact point between them serves as the rotational center of the cartridge B. This contact portion 44 and contact projection 43 are not in the recording medium path; therefore, it is unnecessary to be concerned about their interference with the recording medium, which in turn reduces the number of restrictions regarding the component positioning.

Structure of Electrical Contact Points

Hereinafter referring to FIGS. 5, 8, 9 and 19, the structure of the contact points which makes electrical connections between the process cartridge B and the image forming apparatus A main assembly when the former is installed into the latter, will be described.

The process cartridge B is provided with a plurality of electrical contact points: (1) Electrically conductive grounding contact point 119 electrically connected to the photosensitive drum 7 to ground the drum 7 through the apparatus main assembly A; (2) Electrically conductive charging bias contact point 120 electrically connected to the charging roller shaft 8*a;* (3) Electrically conductive developing bias contact point 121 electrically connected to the developing roller 9*b* in order to apply a developing bias from the apparatus main assembly A; and (4) Electrically conductive toner detecting contact point 122 electrically connected to an antenna wire (line) in order to detect the amount of the remaining toner. All of these four contact points 119–122 are exposed on the lateral surface (right-hand side) of the cartridge frame, with intervals large enough to prevent electrical leakage among them. It should be noted here that the toner detecting contact point 122 doubles as a cartridge detecting contact point for detecting the presence (or absence) of the process cartridge within the apparatus A main assembly.

The grounding contact point 119 is constituted of the electrically conductive axial shaft 7*a* of the photosensitive drum 7, or an electrically conductive insert molded in the shaft 7 of resin material. In this embodiment, it is constituted of a metallic shaft 7*a* of iron or the like. The other contact points 120, 121 and 122 are approximately 0.1 mm to 0.3 mm thick electrically conductive metallic pieces, which are planted on the surface so as for their leg portions to reach into the process cartridge interior. The charging contact point 120 is exposed on the driving side surface (lateral side C1) of the cleaning unit C, and the developing contact point 121 and toner detecting contact point 122 are exposed on the driving side surface (lateral side D1) of the developing unit D.

More specifically, in this embodiment, the helical gear 7*b* is provided at one end of the photosensitive drum 7 in the axial direction of the drum 7 as described before. This helical gear 7*b* engages with the helical gear 28 provided on the apparatus A main assembly to rotate the drum 7. As this helical gear 7*b* rotates, it generates a thrust (in the direction of an arrow d in FIG. 26), pressing thereby the drum 7, which is mounted on the cleaning means frame portion 13 with the allowance of some play in its longitudinal direction, toward the direction of the helical gear 7*b*. As a result, one 7*b*1 of the lateral surfaces of the helical gear 28 remains in contact with the internal surface 13*b*1 of one l3*b* of the lateral surfaces of the cleaning means frame portion 13 of the cartridge frame, whereby the position of the drum 7 within the cartridge B in the axial direction is regulated. The grounding contact point 119 and charging bias contact point 120 are exposed on the one 13*b* of the lateral surfaces of the cleaning means portion 13 of the frame, wherein the grounding contact point 119 is at the end of the drum shaft 7*a*, and projects outward slightly (approximately 0.8 mm) beyond the end of the aforementioned cylindrical member 13*a*. This drum shaft 7*a* is put through the drum cylinder 7*d* (aluminum cylinder in this embodiment) covered with a photosensitive layer 7*e*, and is supported at each end by the cylindrical member 13*a*, which in turn is supported on the lateral walls 13*c* and 13*d*. The drum cylinder 7*d* and shaft 7*a* are connected with a grounding plate 7*f*, which is in contact with both the internal surface 7*d*1 of the drum cylinder 7*d* and peripheral surface 7*a*1 of the shaft 7*a*.

The charging bias contact point 120 is located almost directly above the long guide 12, that is, adjacent to the cleaning means portion 13 of the frame, which supports the charging roller 8 (FIG. 5). Also, the charging bias contact point 120 is electrically connected to the charging roller shaft 8*a* through an electrically conductive member 120*a*, which is in contact with the charging roller shaft 8*a*.

Next, the developing bias contact point 121 and toner detecting contact point 122 will be described. These two contact points 121 and 122 are located on one surface, D1, of the lateral surface of the developing unit D, that is, the same side as the lateral surface 13*b* of the cleaning means portion 13 of the frame. The developing bias contact point 121 is located directly below the long guide 12*a* and adjacent to the frame portion 12*c* where the magnet 9*d* contained in the developing roller 9*c* is supported (FIG. 5), and is electrically connected to the developing roller 9*c* through the electrically conductive member 121*a*, which is in contact with the lateral end of the developing roller 9*c* (FIG. 9(*b*)). The toner detecting contact point 122 is disposed on the upstream side of the long guide 12*a* relative to the cartridge inserting direction (arrow A direction), and is connected to an antenna rod 9*e* extending in the longitudinal direction of the developing roller 9*c* in parallel with the developing roller 9*c*, through the electrically conductive member 9*f*, which is in contact with an antenna rod 9*e*. The antenna rod 9*e* is disposed so as to hold a predetermined distance from the developing roller 9*c*. The capacitance between this antenna rod 9*e* and developing roller 9*c* varies in response to the amount of the toner present between two components. Therefore, the amount of the remaining toner is detected by measuring this capacitance change as a potential difference change through a detecting circuit (unillustrated) in the apparatus main assembly A.

Here, the terminology "amount of the remaining toner" means an amount of the toner that creates a predetermined amount of capacitance by being present between the developing roller 9*c* and antenna rod 9*e*. In other words, the detection of the predetermined amount of capacitance means that the amount of the toner remaining in the toner chamber 11*a* has reached the predetermined amount.

Thus, it is detected by the detecting circuit, which is provided in the apparatus A main assembly and is connected to the cartridge B through the toner detecting contact point 122, that the capacitance has reached a predetermined first value; whereby it is determined that the amount of the toner remaining in the toner chamber 11*a* has reached the predetermined amount. When it is detected that the capacitance has reached the aforementioned first determined value, the apparatus A main assembly signals the need for process cartridge B exchange (for example, flashing light, buzzing sound). When the capacitance detected by the detecting circuit matches a predetermined second value, which is smaller than the first value, the detecting circuit determines that the cartridge B has been installed in the apparatus A main assembly. The detecting circuit does not allow the apparatus A main assembly to be driven unless it detects that the cartridge B has been installed in the apparatus main assembly. It may be arranged so that a warning signal (for example, blinking light or the like) may be provided to inform the operator of the absence of the cartridge B in the apparatus.

Next, a description will be given as to the connection between the contact point provided on the cartridge B and the contact point member provided on the apparatus main assembly.

Referring to FIG. 19, four contact point members, which make contact with corresponding contact points 119–122 when the process cartridge is installed in the apparatus A, are provided on one of the lateral walls of the cartridge accommodating space S of the image forming apparatus A (grounding contact point member 123 which contacts the grounding contact point 119, charging bias contact point member 124 which contacts the charging bias contact point 120, developing contact point member 125 which contacts the developing bias contact point 121, and toner detection contact point member 126 which contacts the toner detecting contact point 122).

As shown in FIGS. 19(*a*) and 19(*b*), the grounding contact point member 123 is disposed in correspondence to the groove 16*a*5. The developing bias contact point member 125 and toner detecting contact point member 126 are disposed below the first guide portion 16*a*. The charging bias contact point member 124 is disposed above the second guide portion 16*b*.

Here, the positional relationship between the contact points and guides will be described.

First, as for the positional relationship in the vertical direction (as seen from the horizontal direction), the developing bias contact point 121 is the bottommost one; the toner detecting contact point 122, long guide 12*a* and cylindrical member 13*a* (grounding contact point 119) are disposed above the bias contact point 121, being at about the same level; above them is the short guide 13*b*, and the topmost one is the charging bias contact point 120. As for the positional relationship in the cartridge inserting direction (arrow X direction), the toner detecting contact point 122 is the most upstream one; next is the long guide 12*a*; at a further downstream location is the charging bias contact 120 and developing bias contact point 121; and at the most downstream locations are short guide 13*b* and cylindrical member 13*a* (grounding contact point 119). Arranging the contact points as described above allows the charging bias contact point 120 to be positioned near the charging roller 8; the developing bias contact point 121, near the developing roller 9*c*; the toner detecting contact point 122, near the antenna rod 9*e*; and the grounding contact point 119 to be positioned near the photosensitive drum 7. Therefore, the wiring for the contact points can be shortened.

The measurements of the contact points are as follows: the charging bias contact point 120 is approximately 10.0 mm in height and width (tolerable range of 8.0 mm to 12.0 mm); developing bias contact point 121, approximately 9.0 mm in height (tolerable range of 6.0 mm to 12.0 mm) and approximately 8.0 mm (tolerable range of 5.0 mm to 11.0 mm) in width; toner detecting contact point 122, approximately 8.0 mm (tolerable range of 6.0 mm to 10.0 mm) in height and approximately 9.0 mm (tolerable range of 7.0 mm to 11.0 mm) in width; and grounding contact point 119 is circular and its diameter is approximately 7.0 mm. The charging bias contact point 120, developing bias contact point 121, and toner detecting contact point 122 are rectangular.

Figure 26:
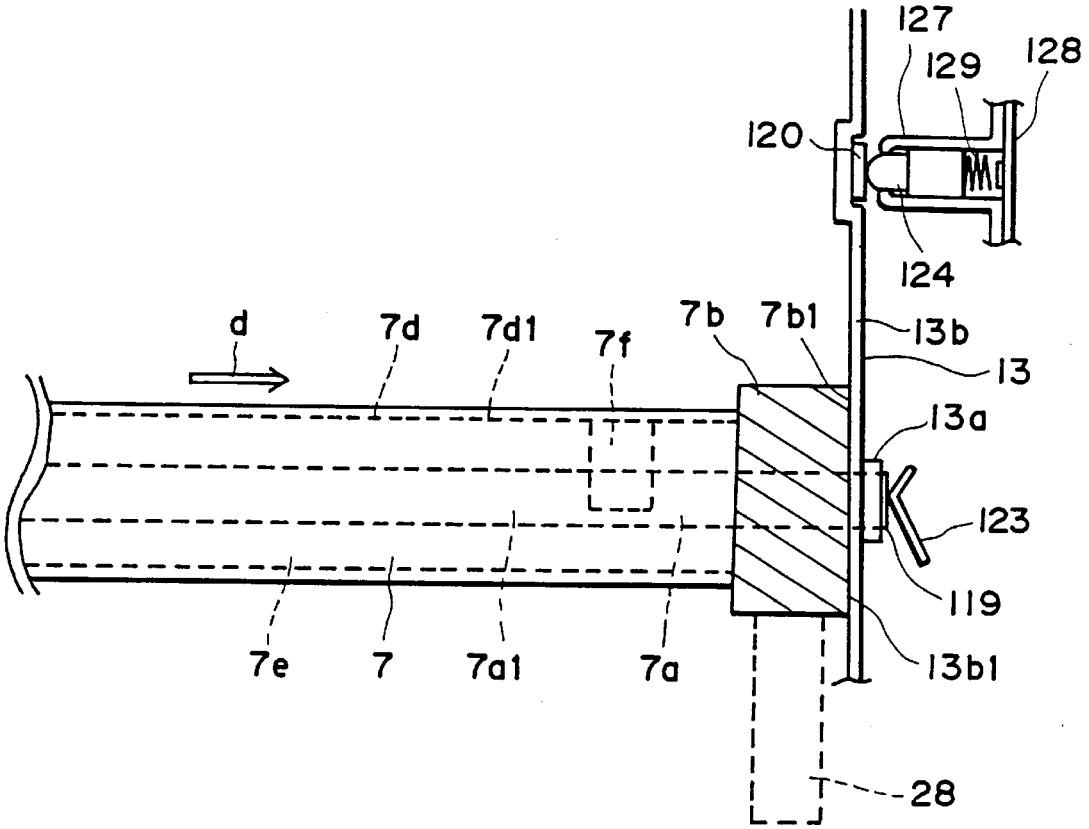
FIGS. 26 and 27 are sectional views of the portion of the process cartridge which depict how contact points remain in contact with the corresponding contact members.

The grounding contact point member 123 is an electrically conductive plate spring member, and is mounted in the groove 16*a*5, in which the cylindrical member 13*a* (in which the drum shaft 7*a* of the photosensitive drum 7 is fitted), on which the grounding contact point 119 of the cartridge B is mounted, is disposed to fix the position of the cartridge B, whereby the grounding contact point member 123 is grounded through the chassis of the apparatus main assembly (FIGS. 16 and 26). The other contact point members 124, 125 and 126 are mounted in the corresponding holder covers 127 in such a manner as to be projected therefrom by the corresponding compression springs 129. This arrangement will be described referring to the charging bias contact point member 124. Referring to FIG. 26, the charging bias contact point member 124 is placed under a holder cover so that it projects but does not come off, and then, this holder cover 127 is fixed to a circuit board 128 mounted on one of the lateral walls of the apparatus main assembly, whereby the contact point members are electrically connected to the wiring patterns by the electrically conductive compression springs 129, correspondingly.

Figure 27:
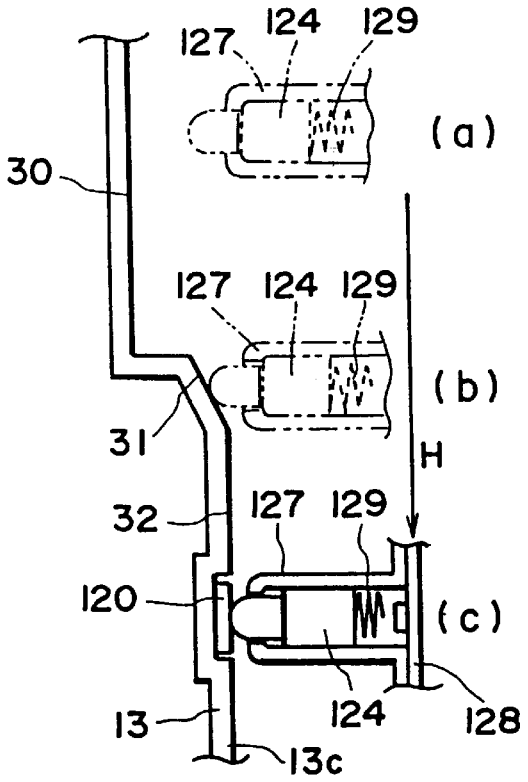

Next, referring to FIG. 27, it will be described with reference to the charging bias contact point member 119 how the contact points on the cartridge side come in contact with the corresponding contact point members on the image forming apparatus side when the process cartridge B is installed into the image forming apparatus A. FIG. 27 is an explanatory drawing, which depicts the state of the process cartridge B in the image forming apparatus A, wherein an arrow mark H designates the movement of the charging bias contact point 124 on the apparatus main assembly, relative to the process cartridge B, when the cartridge B is installed into the image forming apparatus A. It should be noted here that FIG. 27 is a cross-section of FIG. 5 at a line 0.

During the installation of the process cartridge B into the image forming apparatus A using the guide members 16*a* and 16*b* as the guide, the charging bias contact point member 124 is in the state depicted in FIG. 27 before it reaches the predetermined position where it is to be fixedly disposed. At this time, the charging bias contact point member 124 is not in contact with the flat surface 20 of the cleaning means portion 13 of the frame. As the cartridge B is further inserted, the charging bias contact point member 124 is advanced to a position (b) in FIG. 27. In this state, it remains in contact with the slanted surface 31 (FIG. 5) formed on the lateral wall of the cleaning means portion 13 of the frame; slides on this slanted surface 31, whereby it is gradually pressed, compressing thereby gradually the compression spring 129; and smoothly moves onto the flat surface 32 where the charging bias contact point 120 is exposed. When the inserted cartridge B arrives at the predetermined location, the contact member 124 arrives at a position (c) in FIG. 27, where it makes contact with the charging bias contact point 120. The other contact point members 125 and 126 come in contact with the contact points 121 and 122, respectively, in the same manner.

With such an arrangement as described above being in place, when the cartridge B is guided by the guide member 16 into the predetermined cassette accommodating location, the contact points and the corresponding contact point members are reliably placed in contact with each other.

Further, when the process cartridge B is positioned at the predetermined location in the apparatus A main assembly, the grounding contact point member 123 in the form of a plate spring makes contact with the grounding contact point 119 projecting from the cylindrical member 13*a* (FIG. 26).

Next, a case in which the photosensitive drum 7 is rotated by driving the image forming apparatus A, will be described. The photosensitive drum 7 is given a approximately 2 mm to 3 mm thrust play in the axial direction so that it is easier to install the process cartridge B into the image forming apparatus A. Therefore, it is necessary for the charging bias contact point member 124 or the like to be capable of projecting by a distance larger than the thrust play. Further, in this embodiment, a plate spring 45 is provided, which presses the process cartridge B toward one side (side where the contact point members 123–126 are located) of the apparatus main assembly when the cartridge B is in the apparatus main assembly. This plate spring 45 is on the side opposite to the side where the contact point members are located, above the first installation guide 16*a*.

Further, when the contact points 119–122 of the process cartridge B are disposed, as they are in this embodiment, on the side where the helical gear 7*b* is disposed (lateral wall on the driving side), the connection for mechanically driving the cartridge B by the apparatus main assembly through the helical gear 7*b*, and the electrical connection between the cartridge B and apparatus main assembly through the contact points 119–122, can be made on the same side of the cartridge B. Therefore, when the aforementioned side of the cartridge B is used as the preferential side, the integrated error in the component sizes can be reduced, which makes it possible to mount more accurately the contact points and helical gear. Further, when a helical gear with teeth cut in such a direction as to generate a thrust directed toward the side where the helical gear is positioned is used, the position of the photosensitive drum 7 in the axial direction is fixed on the side where the contact points are located; therefore, in this case, the accuracy in the positional relationship between the photosensitive drum 7 and the contact points is also improved, in addition to the aforementioned effects. Further, when a lever 18*b* for opening or closing the drum shutter 18 is located, as it is in the aforementioned embodiment, on the side opposite to the one where the contact points 119–122 are located, the frictional resistance generated on one side of the cartridge by the contact points 119–122 as the cartridge B is inserted into the image forming apparatus A is distributed to the other side as the drum shutter 18 is opened; in other words, the resistance generated when the cartridge B is inserted is evenly distributed in the longitudinal direction of the cartridge B. Therefore, the cartridge B can be smoothly inserted.

Further, as described in the preceding embodiment, when all the contact points of the process cartridge B are positioned on one and the same lateral wall of the cartridge frame, and the process cartridge B is placed under the elastic pressure generated by the plate spring, it is possible to provide stable electrical connections between the contact points and the corresponding contact point members on the apparatus main assembly side.

Figure 28:
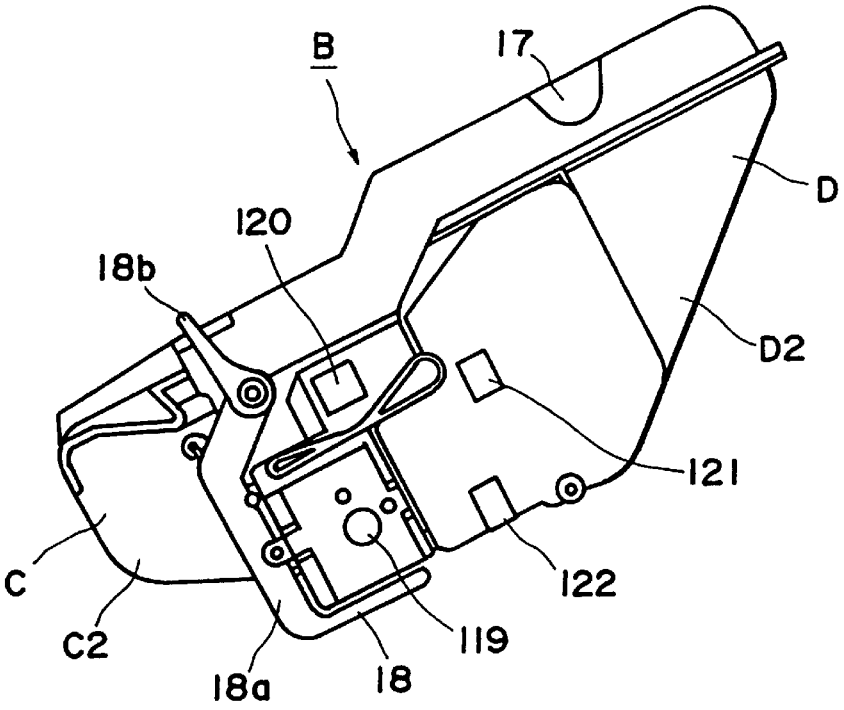
FIG. 28 is a side view of another process cartridge to which the first embodiment of the present invention has been applied.

FIG. 28 illustrates an arrangement in which the contact points are located on the side where the aforementioned lever 18*b* is located. This arrangement can also sufficiently provide the aforementioned effects.

Further, in the preceding embodiments, the process cartridge B is of a type which is used to form a monochrome image, but the present invention is also applicable to a multicolor process cartridge, which comprises two or more developing means and is used to form a multicolor image (image of two colors, three colors, or full-color).

As for the electrophotographic photosensitive member, it is not limited to the aforementioned photosensitive drum 7. The present invention is also applicable to the following. To begin with, the photoconductive material is usable as the photosensitive material. As for the photoconductive material, amorphous silicon, amorphous selenium, zinc oxide, titanium oxide, organic photoconductor (OPC), or the like, is usable. Further, as for the configuration of a base member on which the photosensitive material can be placed, a base member in the form of a drum or a belt is used. For example, in the case of the base member of the drum type, the photoconductive material is coated, deposited, or placed by the like means on a cylinder of aluminum alloy or the like.

As for the developing method, the present invention is compatible with various well-known methods such as the double component magnetic brush developing method, cascade developing method, touch down developing method, cloud developing method, and the like.

Further, as to the structure of the charging means, the so-called contact charging method is employed in the first embodiment, but it is needless to say that the present invention is also applicable to other conventional charging methods such as the one in which a metallic shield of aluminum or the like is placed on three sides of a tungsten wire, and positive or negative ions generated by applying a high voltage to the tungsten wire are transferred onto the surface of the photosensitive drum to charge it uniformly.

Further, the aforementioned charging means may be of the blade type, (charging blade), pad type, block type, rod type, wire type, or the like, in addition to the roller type described previously.

As for the method for cleaning the residual toner on the photosensitive drum, the cleaning means may be constituted of a blade, fur brush, magnetic brush, or the like.

As described in the foregoing, according to the present invention, there is provided a process cartridge and an image forming apparatus usable therewith, wherein the electric connection between the process cartridge and the main assembly of the image forming apparatus can be performed with assurance and accuracy.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, said process cartridge comprising:

an electrophotographic photosensitive drum;

a charging member for charging said photosensitive drum;

a developing member for developing a latent image formed on said photosensitive drum;

an antenna member disposed upstream of said developing member in a mounting direction of said process cartridge in which said process cartridge is mounted to the main assembly;

a cartridge frame;

a charging bias contact for receiving a charging bias voltage from said main assembly to be applied to said charging member by contact with a corresponding contact provided in the main assembly when said process cartridge is mounted to said main assembly;

a developing bias contact for receiving a developing bias voltage to be applied to said developing member by contact with a corresponding contact provided in the main assembly when said process cartridge is mounted to said main assembly, wherein said developing bias contact is connected to said developing member;

a detection contact for permitting detection of mounting of said process cartridge to said main assembly to provide notification to said main assembly, by contact with a corresponding contact provided in the main assembly, that said process cartridge is mounted to said main assembly, wherein said detection contact is connected to said antenna member; and a guiding member for guiding said process cartridge to a mounting position in the main assembly when said process cartridge is mounted to the main assembly, wherein said guiding member is disposed coaxially with said photosensitive drum, wherein said charging bias contact, said developing bias contact, and said detection contact are provided on one end, with respect to a direction of an axis of said photosensitive drum, of said cartridge frame in an outwardly exposed state such that said charging bias contact, said developing bias contact and said detection contact contact respective ones of said corresponding contacts of the main assembly at positions upstream of said guiding member with respect to the mounting direction of said process cartridge, and said developing bias contact and said detection contact are disposed in this order from a downstream side toward an upstream side of said process cartridge in the mounting direction thereof, wherein said guiding member is disposed at said one end.

2. A process cartridge according to claim 1, wherein said guiding member is circular and functions to position said process cartridge to the mounting position.

3. A process cartridge according to claim 1 or 2, further comprising a grounding contact for electrically grounding said photosensitive drum to said main assembly when said process cartridge is mounted to said main assembly.

4. A process cartridge according to claim 3, wherein said grounding contact is surrounded by said guiding member.

5. A process cartridge according to claim 1 or 2, further comprising an elongated guide, at a position which is substantially above said guiding member when said process cartridge is mounted to said main assembly, functioning as a guide when said process cartridge is mounted to said main assembly.

6. A process cartridge according to claim 5, wherein the elongated guide is brought away from a main assembly guiding portion provided in the main assembly, when said process cartridge is positioned at the mounting position.

7. A process cartridge according to claim 1, further comprising an additional guiding member at the other end opposite from said one end in a longitudinal direction of said photosensitive drum to guide process cartridge to the mounting position.

8. A process cartridge according to claim 7, wherein said additional guiding member is disposed coaxial with said photosensitive drum.

9. A process cartridge according to claim 3, wherein when said process cartridge is mounted to said main assembly, said charging bias contact is disposed substantially above said grounding contact, and said grounding contact, said developing bias contact, and said detection contact are disposed in this order from a downstream side toward an upstream side of said process cartridge in the mounting direction thereof, and when said process cartridge is mounted to said main assembly, said charging member is disposed substantially above said photosensitive drum, and said developing member is disposed upstream of said photosensitive drum in the mounting direction.

10. A process cartridge according to claim 1 or 2, further comprising an elongated guide, at a position which is substantially above said grounding contact when said process cartridge is mounted to said main assembly.

11. An image forming apparatus for forming an image on a recording material, said image forming apparatus comprising:

(a) mounting means for removably mounting a process cartridge to a main assembly of said image forming apparatus, said process cartridge including:

an electrophotographic photosensitive drum;

a charging member for charging said photosensitive drum, a developing member for developing a latent image formed on said photosensitive drum, an antenna member disposed upstream of said developing member in a mounting direction of said process cartridge in which said process cartridge is mounted to the main assembly;

a cartridge frame, a charging bias contact for receiving a charging bias voltage from said main assembly to be applied to said charging member by contact with a corresponding contact provided in the main assembly when said process cartridge is mounted to said main assembly;

a developing bias contact for receiving a developing bias voltage to be applied to said developing member by contact with a corresponding contact provided in the main assembly when said process cartridge is mounted to said main assembly wherein said developing bias contact is connected to said developing member;

a detection contact for permitting detection of mounting of said process cartridge to said main assembly to provide notification to said main assembly, by contact with a corresponding contact provided in the main assembly, that said process cartridge is mounted to said main assembly, wherein said detection contact is connected to said antenna member, and a guiding member for guiding said process cartridge to a mounting position in the main assembly when said process cartridge is mounted to the main assembly, wherein said guiding member is disposed coaxially with said photosensitive drum, wherein said charging bias contact, said developing bias contact, and said detection contact are provided on one end, with respect to a direction of an axis of said photosensitive drum, of said cartridge frame in an outwardly exposed state such that said charging bias contact, said developing bias contact and said detection contact contact respective ones of said corresponding contacts of the main assembly at positions upstream of said guiding member with respect to the mounting direction of said process cartridge, and said developing bias contact and said detection contact contact are disposed in this order from a downstream side toward an upstream side of said process cartridge in the mounting direction thereof; and wherein said guiding member is disposed at said one end;

(b) a main assembly guide for guiding said guiding member;

(c) a charging bias contact member forming an electrical connection with the charging bias contact;

(d) a developing bias contact member forming an electrical connection with the developing bias contact; and (e) a detection contact member forming an electrical connection with the detection contact.

12. A process cartridge detachably mountable to a main assembly of an image forming apparatus, said process cartridge comprising:

an electrophotographic photosensitive drum;

a cleaning member for removing developer remaining on said photosensitive drum;

a removed developer accommodating portion for accommodating the developer removed by said cleaning member;

a charging roller for charging said photosensitive drum;

a developing roller for developing a latent image formed on said photosensitive drum;

an antenna member disposed upstream of said developing roller in a mounting direction of said process cartridge in which said process cartridge is mounted to the main assembly;

a developer accommodating portion for accommodating a developer to be used for developing the latent image by said developing roller;

a cartridge frame;

a charging bias contact for receiving a charging bias voltage from said main assembly to be applied to said charging roller by contact with a corresponding contact provided in the main assembly when said process cartridge is mounted to said main assembly, wherein said charging bias contact is connected to said charging roller;

a developing bias contact for receiving a developing bias voltage to be applied to said developing roller by contact with a corresponding contact provided in the main assembly when said process cartridge is mounted to said main assembly, wherein said developing bias contact is connected with said developing roller;

a detection contact for permitting detection of mounting of said process cartridge to said main assembly to provide notification to said main assembly, by contact with a corresponding contact provided in the main assembly, that said process cartridge is mounted to said main assembly, wherein said detection contact is connected with said antenna member; and a circular guiding member for guiding and positioning said process cartridge to a mounting position in the main assembly when said process cartridge is mounted to the main assembly, wherein said guiding member is disposed coaxially with said photosensitive drum, and a grounding contact for electrically grounding said photosensitive drum to said main assembly by contact with a corresponding contact provided in the main assembly when said process cartridge is mounted to said main assembly;

wherein said grounding contact is a part of a shaft that supports said photosensitive drum to said cartridge frame, wherein said charging bias contact, said developing bias contact, and said detection contact are provided on one end, with respect to a direction of an axis of said photosensitive drum, of said cartridge frame in an outwardly exposed state such that said charging bias contact, said developing bias contact, and said detection contact contact respective ones of said corresponding contacts of the main assembly at positions upstream of said guiding member with respect to the mounting direction of said process cartridge, and said grounding contact, said developing bias contact, and said detection contact are disposed in this order from a downstream side toward an upstream side of said process cartridge in the mounting direction thereof, wherein said grounding contact, said charging bias contact, said developing bias contact, and said detection contact are provided on one end, with respect to a direction of an axis of said photosensitive drum, of said cartridge frame in an outwardly exposed state, and wherein said guiding member is disposed at said one end, and wherein said process cartridge is mounted to the main assembly of said apparatus with said removed developer accommodating portion being at a leading side of said process cartridge and said developer accommodating portion for accommodating the developer to be used for developing the latent image at a trailing side of said process cartridge.

13. A process cartridge according to claim 12, wherein said grounding contact is surrounded by said guiding member.

14. A process cartridge according to claim 12 or 13, further comprising an elongated guide, at a position which is substantially above said grounding contact when said process cartridge is mounted to said main assembly, functioning as a guide when said process cartridge is mounted to said main assembly.

15. A process cartridge according to claim 14, wherein the elongated guide is brought away from a main assembly guiding portion provided in the main assembly, when said process cartridge is positioned at the mounting position.

16. A process cartridge according to claim 12 or 13, further comprising an additional guiding member at the other end opposite from said one end in a longitudinal direction of said photosensitive drum to guide said process cartridge to the mounting position.

17. A process cartridge detachably mountable to a main assembly of an image forming apparatus, said process cartridge comprising:

an electrophotographic photosensitive drum;

a cleaning member for removing developer remaining on said photosensitive drum;

a removed developer accommodating portion for accomodating the developer removed by said cleaning member;

a charging roller for charging said photosensitive drum;

a developing roller for developing a latent image formed on said photosensitive drum;

an antenna member disposed upstream of said developing roller in a mounting direction of said process cartridge in which said process cartridge is mounted to the main assembly;

a developer accomodating portion for accomodating a developer to be used for developing the latent image by said developing roller;

a cartridge frame;

a charging bias contact for receiving a charging bias voltage from said main assembly to be applied to said charging roller by contact with a corresponding contact provided in the main assembly when said process cartridge is mounted to said main assembly, wherein said charging bias contact is connected to said charging roller;

a developing bias contact for receiving a developing bias voltage to be applied to said developing roller by contact with a corresponding contact provided in the main assembly when said process cartridge is mounted to said main assembly, wherein said developing bias contact is connected to said developing roller;

a detection contact for permitting detection of mounting of said process cartridge to said main assembly to provide notification to said main assembly, by contact with a corresponding contact provided in the main assembly, that said process cartridge is mounted to said main assembly, wherein said detection contact is connected with said antenna member;

a first guiding member, which is circular, for guiding and positioning said process cartridge to a mounting position in the main assembly when said process cartridge is mounted to the main assembly, wherein said first guiding member is disposed coaxially with said photosensitive drum;

a first elongated guide for guiding said process cartridge to a mounting position in the main assembly when said process cartridge is mounted to the main assembly, wherein said first elongated guide is disposed at one end, with respect to direction of an axis of said photosensitive drum;

a second guiding member at the other end opposite from said one end in a longitudinal direction of said photosensitive drum to guide process cartridge to the mounting position, wherein said second guiding member is disposed coaxial with said photosensitive drum;

a second elongated guide for guiding said process cartridge to a mounting position in the main assembly where said process cartridge is mounted to the main assembly, wherein said second elongated guide is disposed at the other end;

a grounding contact for electrically grounding said photosensitive drum to said main assembly by contact with a corresponding contact provided in the main assembly when said process cartridge is mounted to said main assembly;

wherein said grounding contact is a part of a shaft that supports said photosensitive drum to said cartridge frame, wherein said charging bias contact, said developing bias contact, and said detection contact are provided on said one end, with respect to the direction of an axis of said photosensitive drum, of said cartridge frame in an outwardly exposed state such that said charging bias contact, said developing bias contact and said detection contact respective ones of said corresponding contacts of the main assembly at positions upstream of said first guiding member with respect to the mounting direction of said process cartridge, and said grounding contact, said developing bias contact, and said detection contact are disposed in this order from a downstream side toward an upstream side of said process cartridge in the mounting direction thereof, wherein said grounding contact, said charging bias contact, said developing bias contact, and said detection contact are provided on said one end, with respect to a direction of an axis of said photosensitive drum, of said cartridge frame in an outwardly exposed state, and wherein said first guiding member is disposed at said one end, wherein said process cartridge is mounted to the main assembly of said apparatus with said removed developer accommodating portion being at a process-cartridge leading side and said developer accommodating portion for accommodating the developer to be used for developing the latent image at a process-cartridge trailing side, wherein said developer accommodating portion for accommodating the developer to be used for developing the latent image is provider with a grip portion for facilitating mounting and demounting of said process cartridge relative to the main assembly of said apparatus.

18. A process cartridge detachably mountable to a main assembly of an image forming apparatus, said process cartridge comprising:

an electrophotographic photosensitive drum;

a cleaning member for removing developer remaining on said photosensitive drum;

a removed developer accommodating portion for accommodating the developer removed by said cleaning member;

a charging roller for charging said photosensitive drum;

a developing roller for developing a latent image formed on said photosensitive drum;

an antenna member disposed upstream of said developing roller in a mounting direction of said process cartridge in which said process cartridge is mounted to the main assembly;

a developer accommodating portion for accommodating a developer to be used for developing the latent image by said developing roller;

a cartridge frame;

a charging bias contact for receiving a charging bias voltage from said main assembly to be applied to said charging roller by contact with a corresponding contact provided in the main assembly when said process cartridge is mounted to said main assembly, wherein said charging bias contact is connected to said charging roller;

a developing bias contact for receiving a developing bias voltage to be applied to said developing roller by contact with a corresponding contact provided in the main assembly when said process cartridge is mounted to said main assembly, wherein said developing bias contact is connected to said developing roller;

a detection contact for permitting detection of mounting of said process cartridge to said main assembly to provide notification to said main assembly, by contact with a corresponding contact provided in the main assembly, that said process cartridge is mounted to said main assembly, wherein said detection contact is connected with said antenna member;

a first guiding member, which is circular, for guiding and positioning said process cartridge to a mounting position in the main assembly when said process cartridge is mounted to the main assembly, wherein said first guiding member is disposed coaxially with said photosensitive drum;

a first elongated guide for guiding said process cartridge to a mounting position in the main assembly when said process cartridge is mounted to the main assembly, wherein said first elongated guide is disposed at one end, with respect to a direction of an axis of said photosensitive drum;

a second guiding member at the other end opposite from said one end in a longitudinal direction of said photosensitive drum to guide process cartridge to the mounting position, wherein said second guiding member is disposed coaxial with said photosensitive drum;

a second elongated guide for guiding said process cartridge to a mounting position in the main assembly where said process cartridge is mounted to the main assembly, wherein said second elongated guide is disposed at the other end;

a grounding contact for electrically grounding said photosensitive drum to said main assembly by contact with a corresponding contact provided in the main assembly when said process cartridge is mounted to said main assembly;

wherein said grounding contact is a part of a shaft that supports said photosensitive drum to said cartridge frame, wherein said charging bias contact, said developing bias contact, and said detection contact are provided on said one end, with respect to the direction of an axis of said photosensitive drum, of said cartridge frame in an outwardly exposed state such that said charging bias contact, said developing bias contact and said detection contact contact respective ones of said corresponding contacts of the main assembly at positions upstream of said first guiding member with respect to the mounting direction of said process cartridge, and said grounding contact, said developing bias contact, and said detection contact are disposed in this order from a downstream side toward an upstream side of said process cartridge in the mounting direction thereof, wherein said grounding contact, said charging bias contact, said developing bias contact, and said detection contact are provided on said one end, with respect to a direction of an axis of said photosensitive drum, of said cartridge frame in an outwardly exposed state, and wherein said first guiding member is disposed at said one end, wherein said process cartridge is mounted to the main assembly of said apparatus with said removed developer accommodating portion being at a process-cartridge leading side and said developer accommodating portion for accommodating the developer to be used for developing the latent image at a process-cartridge trailing side, wherein said developer accommodating portion for accommodating the developer to be used for developing the latent image is provided with a grip portion for facilitating mounting and demounting of said process cartridge relative to the main assembly of said apparatus.

19. A process cartridge according to claim 17, wherein said first elongated guide is disposed, at a position which is substantially above said grounding contact when said process cartridge is mounted to said main assembly.

20. A process cartridge according to claim 18, wherein the first elongated and a second elongated guide are brought away from a main assembly guiding portion provided in the main assembly, when said process cartridge is positioned at the mounting position.

21. A process cartridge according to claim 12 or 18, wherein when said process cartridge is mounted to said main assembly, said charging bias contact is disposed substantially above said grounding contact, and when said process cartridge is mounted to said main assembly, said charging roller is disposed substantially above said photosensitive drum, and said developing roller is disposed upstream of said photosensitive drum in the mounting direction.

22. A process cartridge according to claim 18, wherein when said process cartridge is mounted to said main assembly, said charging bias contact is disposed substantially above said grounding contact, and the grounding contact, said developing bias contact, and said detection contact are disposed in this order from a downstream side toward an upstream side of said process cartridge in the mounting direction thereof, and when said process cartridge is mounted to said main assembly, said charging means is disposed substantially above said photosensitive drum, and said developing means is disposed upstream of said photosensitive drum in the mounting direction.

23. A process cartridge according to claim 1 or 22, wherein said detection contact is also used for transmitting to said main assembly information indicating that a remaining amount of a developer reaches a predetermined level.

24. A process cartridge according to claim 12 or 18, wherein said detection contact is also used for transmitting to said main assembly information indicating that a remaining amount of the developer reaches a predetermined level.

* * * * *

UNITED STATES PATENT AND TRADEMARK OFFICE

CERTIFICATE OF CORRECTION

PATENT NO. : 6,128,452
DATED : October 3, 2000
INVENTOR(S) : Shigeo Miyabe et al.

It is certified that error appears in the above-identified patent and that said Letters Patent is hereby corrected as shown below:

Title page,
Item [56], References Cited, FOREIGN PATENT DOCUMENTS, "02163761" should read -- 02-163761 --, and "4018920" should read -- 4-018920 --.
Item [22], Filed, "Jul. 24, 1998" should read -- Jul. 27, 1998 --.
Item [57], ABSTRACT,
Line 3, "a guiding member," should be deleted.

Column 2,
Line 54, "process" should read -- process cartridges --.

Column 6,
Line 46, "axia" should read -- axial --; and
Line 47, "7," should read -- 7 --.

Column 13,
Line 42, "pull" should read -- pulls --.

Column 18,
Line 21, "a" should be deleted.

Column 19,
Line 26, "is" should read -- can be --.

Column 21,
Lines 23-26, should read as follows:
-- 10. A process cartridge according to Claim 16, wherein said additional guiding member is disposed coaxial with said photosensitive drum. --.

Column 25,
Lines 31-33, should read as follows: -- A process cartridge according to Claim 17, wherein said grounding contact is surrounded by said guiding member. --.
Delete lines 34-67.

Column 26,
Delete lines 1-67

UNITED STATES PATENT AND TRADEMARK OFFICE

CERTIFICATE OF CORRECTION

PATENT NO. : 6,128,452
DATED : October 3, 2000
INVENTOR(S) : Shigeo Miyabe et al.

It is certified that error appears in the above-identified patent and that said Letters Patent is hereby corrected as shown below:

Column 27,
Delete lines 1-4.

Signed and Sealed this

Second Day of March, 2004

JON W. DUDAS
*Acting Director of the United States Patent and Trademark Office*